US011075453B1

(12) United States Patent
Bulumulla et al.

(10) Patent No.: US 11,075,453 B1
(45) Date of Patent: Jul. 27, 2021

(54) MICROELECTRONICS PACKAGE WITH ULTRA-LOW-K DIELECTRIC REGION BETWEEN STACKED ANTENNA ELEMENTS

(71) Applicant: GLOBALFOUNDRIES U.S. Inc., Malta, NY (US)

(72) Inventors: Selaka B. Bulumulla, Niskayuna, NY (US); Koushik Ramachandran, Wappingers Falls, NY (US); Benjamin V. Fasano, New Windsor, NY (US)

(73) Assignee: GLOBALFOUNDRIES U.S. Inc., Malta, NY (US)

( * ) Notice: Subject to any disclaimer, the term of this patent is extended or adjusted under 35 U.S.C. 154(b) by 0 days.

(21) Appl. No.: 16/804,126

(22) Filed: Feb. 28, 2020

(51) Int. Cl.
*H01Q 1/42* (2006.01)
*H01Q 1/50* (2006.01)
*H01Q 21/06* (2006.01)

(52) U.S. Cl.
CPC ..... *H01Q 1/422* (2013.01); *H01Q 1/50* (2013.01); *H01Q 21/064* (2013.01)

(58) Field of Classification Search
CPC ..... H01Q 1/422; H01Q 1/50; H01Q 21/064
See application file for complete search history.

(56) References Cited

U.S. PATENT DOCUMENTS 7,119,745 B2 10/2006 Gaucher et al.
8,018,384 B2 9/2011 Floyd et al.
8,816,929 B2 8/2014 Kam et al.
9,620,464 B2 4/2017 Baks et al.
9,917,346 B2 * 3/2018 Ramachandran ..... H01Q 1/50
9,985,346 B2 5/2018 Baks et al.
10,529,704 B1 * 1/2020 Cimino ..... H01L 27/0255
2003/0201941 A1 * 10/2003 Aikawa ..... H01Q 13/106 343/700 MS
2005/0110684 A1 * 5/2005 Liu ..... H01Q 1/242 343/700 MS
2012/0212384 A1 8/2012 Kam et al.
(Continued)

OTHER PUBLICATIONS

Gu et al., "A Multilayer Organic Package with 64 Dual-Polarized Antennas for 28GHz 5G Communication," IEEE, 2017, pp. 1-3.
(Continued)

*Primary Examiner* — Lam T Mai
(74) *Attorney, Agent, or Firm* — Gibb & Riley, LLC; Anthony J. Canale

(57) ABSTRACT

Disclosed are embodiments of a microelectronics package that includes: first and second substrates (each having first and second sides); a chip; and a multi-element antenna connected to the chip. The chip is mounted on the first side of the first substrate. A first antenna element of the antenna is on the second side of the first substrate and electrically connected to the chip. The first side of the second substrate is adhered to the second side of the first substrate (i.e., covering the first antenna element). A second antenna element of the antenna is on the second side of the second substrate overlaying the first antenna element and physically separated therefrom by at least one ultra-low-K dielectric region within the first side of the second substrate and/or the second side of the first substrate. Optionally, the package includes multiple chips and/or multiple antennas. Also disclosed are associated method embodiments.

20 Claims, 28 Drawing Sheets

(56) References Cited

U.S. PATENT DOCUMENTS

| | | | | |
|---|---|---|---|---|
| 2013/0037924 | A1* | 2/2013 | Lee | H01L 23/49822 257/664 |
| 2014/0035097 | A1* | 2/2014 | Lin | H01L 23/66 257/531 |
| 2014/0210486 | A1* | 7/2014 | Dijkstra | H01Q 21/29 324/612 |
| 2014/0266902 | A1* | 9/2014 | Kamgaing | H01Q 15/08 342/374 |
| 2019/0140361 | A1 | 5/2019 | Labonte et al. | |
| 2019/0229413 | A1* | 7/2019 | Jong | H01Q 21/062 |
| 2020/0014119 | A1* | 1/2020 | Kim | H01Q 1/44 |
| 2020/0295454 | A1* | 9/2020 | Yun | H01Q 15/006 |
| 2020/0329556 | A1* | 10/2020 | Baek | H05K 1/0239 |
| 2020/0358173 | A1* | 11/2020 | Jong | H01Q 21/065 |

OTHER PUBLICATIONS

Kam et al., "LTCC Packages With Embedded Phased-Array Antennas for 60GHz Communications," IEEE Microwave and Wireless Componenents Letters, vol. 21, No. 3, 2011, pp. 141-144.

Mitsubishi Gas Chemical, "Non-Haloganated Low CTW BT Resin Laminate for IC," https://www.mgc.co.jp/eng/products/sc/btprint/lineup/hfbt.html, Accessed on Feb. 3, 2020, pp. 1-14.

Valdes-Garcia, Alberto, "Millimeter-Wave Phased Array for 5G," IBM T. J. Watson Research Center, 2018, pp. 1-49.

Zhang et al., "Antenna-on-Chip and Antenna-in-Package Solutions to Highly Integrated Millimeter-Wave Devices for Wireless Communications," IEEE Transactions on Antennas and Propagation, vol. 57, No. 10, 2009, pp. 2830-2841.

* cited by examiner

OR

OR

MICROELECTRONICS PACKAGE WITH ULTRA-LOW-K DIELECTRIC REGION BETWEEN STACKED ANTENNA ELEMENTS

BACKGROUND

Field of the Invention

The present invention relates to antenna in package (AiP) solutions and, more particularly, to a microelectronics package that incorporates an ultra-low-K dielectric region (e.g., air gap or other ultra-low-K dielectric material region) between stacked antenna elements for bandwidth optimization.

Description of Related Art

More specifically, antenna-in-package (AiP) structures are microelectronics packages that are employed in wireless communication devices (e.g., radio frequency (RF) devices). An AiP structure includes: a laminate substrate having a first surface and a second surface opposite the first surface; an integrated circuit (IC) chip (e.g., an RF IC chip) that is mounted onto the first surface (e.g., using solder balls, copper pillars, or wire bond interconnections); and an antenna on the second surface and electrically connected to the RF chip. Recently, multi-element antennas and, particularly, antennas with stacked antenna elements have been developed and incorporated into AiP structures in order to achieve wider bandwidths. Typically, a microelectronics package with a multi-element antenna includes: a first antenna element and a second antenna element. The first antenna element is on the second surface of the laminate substrate and electrically connected to the IC chip. The second antenna element is on an additional substrate. A frame with a center opening is mounted onto the second surface of the laminate substrate using solder balls such that the first antenna element is exposed within the center opening and the second substrate is mounted on the top of the frame also using solder balls such that the second antenna element is aligned above the first antenna element, is parasitically coupled to the first antenna element and is physically separated from the first antenna element by an air-gap. Such a microelectronics package with a multi-element antenna can be relatively expensive to fabricate and can suffer reliability issues due to high stress on the solder balls.

SUMMARY

In view of the foregoing, disclosed herein are embodiments of a more robust microelectronics package that incorporates multi-element antenna(s) and, particularly, one or more antennas each having stacked antenna elements). The package can include a first substrate and a second substrate, each having a first side (e.g., a bottom side) and a second side (e.g., a top side). The package can further include at least one chip and at least one multi-element antenna connected to each chip. For example, a chip can be mounted on the first side of the first substrate. A first antenna element of the multi-element antenna can be on the second side of the first substrate and electrically connected to the chip. The first side of the second substrate can be adhered by an adhesive (e.g., an epoxy adhesive) to the second side of the first substrate (i.e., over the first antenna element). A second antenna element of the multi-element antenna can be on the second side of the second substrate overlaying and parasitically coupled to the first antenna element. The second antenna element can further be physically separated from the first antenna element by at least one ultra-low-K dielectric region (e.g., at least one ultra-low-K dielectric-containing trench) within the first side of the second substrate and/or the second side of the first substrate. Optionally, the package can include multiple chips connected multi-element antennas, respectively; a single chip connected to multiple multi-element antennas, or multiple chips, each connected to multiple multi-element antennas. Also disclosed herein are method embodiments for forming such microelectronics packages.

More particularly, one embodiment of a microelectronics package disclosed herein can include a first substrate (e.g., a laminate substrate) and a second substrate (e.g., a single polymer layer substrate). The first substrate and the second substrate can each have a first side (e.g., a bottom side) and a second side (e.g., a top side) opposite the first side. The second side of the first substrate can be adhered to the first side of the second substrate by an adhesive (e.g., an epoxy adhesive). A chip can be mounted on the first side of the first substrate (e.g., by solder balls). A multi-element antenna for the chip (i.e., an antenna with stacked antenna elements) can include a first antenna element and a second antenna element. The first antenna element can be on the second side of the first substrate so as to be covered by the second substrate and can further be electrically connected to the chip. The second antenna element can be on the second side of the second substrate, can overlay the first antenna element (e.g., can be above the first antenna element), can be parasitically coupled to the first antenna element, and can be physically separated from the first antenna element by at least one ultra-low-K dielectric region (e.g., at least one ultra-low-K dielectric-containing trench) within the first side of the second substrate and/or the second side of the first substrate. Optionally, the microelectronics package can further include multiple chips connected to multiple multi-element antennas, respectively.

Another embodiment of a microelectronics package disclosed herein can similarly include a first substrate (e.g., a laminate substrate) and a second substrate (e.g., a single polymer layer substrate). The first substrate and the second substrate can each have a first side (e.g., a bottom side) and a second side (e.g., a top side) opposite the first side. The second side of the first substrate can be adhered to the first side of the second substrate by an adhesive (e.g., an epoxy adhesive). A chip can be mounted on the first side of the first substrate. The package can further include multiple multi-element antennas for the chip (i.e., multiple antennas each with stacked antenna elements). Specifically, each antenna can include a first antenna element and a second antenna element. The first antenna element for a given antenna can be on the second side of the first substrate so as to be covered by the second substrate and can further be electrically connected to the chip. The second antenna element for the given antenna can be on the second side of the second substrate, can overlay and be parasitically coupled to the first antenna element for that antenna (e.g., can be aligned above the first antenna element) and can be physically separated from that first antenna element by at least one corresponding ultra-low-K dielectric region (e.g., at least one corresponding ultra-low-K dielectric-containing trench) within the first side of the second substrate and/or the second side of the first substrate. Optionally, the microelectronics package can further include multiple chips, each connected to multiple multi-element antennas.

It should be understood that the embodiments described above are for illustration purposes and are not intended to be limiting. Yet another embodiment of a microelectronics package could include multiple chips and each chip could be connected to one or more multi-element antennas (e.g., a first chip connected to a single multi-element antenna and a second chip connected to multiple multi-element antennas).

As discussed further in the detailed description section, each ultra-low-K dielectric region includes a trench that is within either the second side of the first substrate or the first side of the second substrate) and the trench contains an ultra-low-K dielectric material (i.e., a dielectric material with a constant that is no greater than 2.5 such as air, a fluoropolymer, or a porous fluoropolymer).

Also disclosed herein are method embodiments for forming the above-described microelectronics packages. The method embodiments can include fabricating a first substrate (e.g., a laminate substrate) and a second substrate (e.g., a single polymer layer substrate, an additional laminate substrate, or some other suitable single or multi-layer substrate). The first substrate and the second substrate can each have a first side (e.g., a bottom side) and a second side (e.g., a top side) opposite the first side. The method embodiments can further include mounting a chip on the first side of the first substrate. The method embodiments can further include adhering the second side of the first substrate to the first side of the second substrate using an adhesive (e.g., an epoxy adhesive) in order to form a microelectronics package. The fabricating, mounting and adhering process steps can be performed so that the resulting microelectronics package includes a multi-element antenna (i.e., an antenna with stacked antenna elements) for the chip. This multi-element antenna can include a first antenna element and a second antenna element. The first antenna element can be on the second side of the first substrate so as to be covered by the second substrate. The first antenna element can further be electrically connected to the chip by a metal interconnect structure that extends through the first substrate from the first antenna element on the second side to the chip on the first side. The second antenna element can be on the second side of the second substrate, can overlay the first antenna element (e.g., can be above the first antenna element), can be parasitically coupled to the first antenna element, and can be physically separated from the first antenna element by at least one ultra-low-K dielectric region (e.g., at least one ultra-low-K dielectric-containing trench) within the first side of the second substrate and/or the second side of the first substrate. Optionally, the fabricating, mounting, and adhering process steps can be performed so that the resulting microelectronics package includes any of the following: a single chip connected to multiple multi-element antennas; multiple chips connected to multi-element antennas, respectively; or multiple chips, each connected to multiple multi-element antennas.

BRIEF DESCRIPTION OF THE DRAWINGS

The present invention will be better understood from the following detailed description with reference to the drawings, which are not necessarily drawn to scale and in which.

DETAILED DESCRIPTION

Figure 1A:
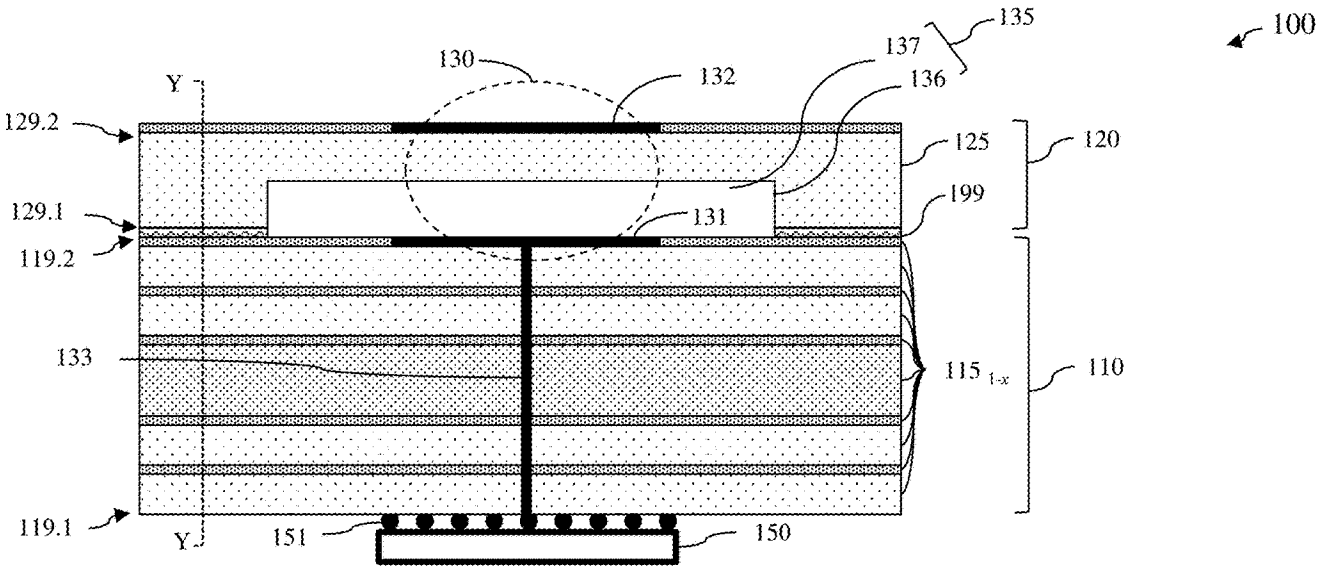
FIGS. 1A-1B are cross-section diagrams of one embodiment of a microelectronics package including a first substrate and a second substrate.

As mentioned above, antenna-in-package (AiP) structures are microelectronics packages that are employed in wireless communication devices (e.g., radio frequency (RF) devices). An AiP structure includes: a laminate substrate having a first surface and a second surface opposite the first surface; an integrated circuit (IC) chip (e.g., an RF IC chip) that is mounted onto the first surface (e.g., using solder balls, copper pillars, or wire bond interconnections); and an antenna on the second surface and electrically connected to the RF chip. Recently, multi-element antennas and, particularly, antennas with stacked antenna elements have been developed and incorporated into AiP structures in order to achieve wider bandwidths. Typically, a microelectronics package with a multi-element antenna includes: a first antenna element and a second antenna element. The first antenna element is on the second surface of the laminate substrate and electrically connected to the IC chip. The second antenna element is on an additional substrate. A frame with a center opening is mounted onto the second surface of the laminate substrate using solder balls such that the first antenna element is exposed within the center opening and the second substrate is mounted on the top of the frame also using solder balls such that the second antenna element is aligned above the first antenna element, is parasitically coupled to the first antenna element and is physically separated from the first antenna element by an air-gap. Such a microelectronics package with a multi-element antenna can be relatively expensive to fabricate and can suffer reliability issues due to high stress on the solder balls.

In view of the foregoing, disclosed herein are embodiments of a more robust microelectronics package that incorporates multi-element antenna(s) (i.e., antenna(s) with stacked antenna elements). The package can include a first substrate and a second substrate, each having a first side (e.g., a bottom side) and a second side (e.g., a top side). The package can further include at least one chip and at least one multi-element antenna connected to each chip. For example, a chip can be mounted on the first side of the first substrate. A first antenna element of the multi-element antenna can be on the second side of the first substrate and electrically connected to the chip. The first side of the second substrate can be adhered by an adhesive (e.g., an epoxy adhesive) to the second side of the first substrate (i.e., over the first antenna element). A second antenna element of the multi-element antenna can be on the second side of the second substrate overlaying and parasitically coupled to the first antenna element. The second antenna element can further be physically separated from the first antenna element by at least one ultra-low-K dielectric region (i.e., at least one ultra-low-K dielectric-containing trench) within the first side of the second substrate and/or the second side of the first substrate. Optionally, the microelectronics package can include multiple chips connected multi-element antennas, respectively, a single chip connected to multiple multi-element antennas, or multiple chips, each connected to multiple multi-element antennas. Also disclosed herein are method embodiments for forming such microelectronics packages.

More particularly, referring to FIGS. 1A-1C, 2A-2B, 3A-3B, 4A-4F, 5A-5E and 6A-6E, disclosed herein are various embodiments of a microelectronics package 100, 200, 300, 400, 500, and 600.

The microelectronics package 100, 200, 300, 400, 500, 600 can include a first substrate 110, 210, 310, 410, 510, 610 (also referred to as a chip-first antenna element carrier). The first substrate 110, 210, 310, 410, 510, 610 can have a first side 119.1, 219.1, 319.1, 419.1, 519.1, 619.1 (e.g., a bottom side) and a second side 119.2, 219.2, 319.2, 419.2, 519.2, 619.2 (e.g., a top side) opposite the first side. The first substrate 110, 210, 310, 410, 510, 610 can be an organic laminate substrate. This organic laminate substrate can be a conventional organic laminate substrate used for microelectronics packages. That is, the organic laminate substrate can include multiple thin organic layers $\mathbf{115}_{1-x}$, $\mathbf{215}_{1-x}$, $\mathbf{315}_{1-x}$, $\mathbf{415}_{1-x}$, $\mathbf{415}_{1-x}$, $\mathbf{615}_{1-x}$ (e.g., of polymers, resins, etc.) (including, for example, a core and build up layer) stacked so as to form a rigid structure. The organic laminate substrate can further include various interconnect structures (e.g., vias and wires, as discussed in greater detail below) embedded within the layers. It should be understood that various different organic laminate substrate configurations for microelectronics packages are known in the art and any of these different organic laminate substrates could be incorporated into the microelectronics package embodiments disclosed herein as the first substrate.

The microelectronics package 100, 200, 300, 400, 500, 600 can also include a second substrate 120, 220, 320, 420, 520, 620 (also referred to herein as a second antenna element carrier or a parasitic antenna element carrier). The second substrate 120, 220, 320, 420, 520, 620 can have a first side 129.1, 229.1, 329.1, 429.1, 529.1, 629.1 (e.g., a bottom side) and a second side 129.2, 229.2, 329.2, 429.2, 529.2, 629.2 (e.g., a top side) opposite the first side. The second substrate 120, 220, 320, 420, 520, 620 can be an organic polymer layer 125, 225, 325, 425, 525, 625. For example, the second substrate could be made of a liquid crystal polymer (LCP) and fabricated using injection molding (as discussed further below with regard to the method embodiments). Alternatively, the second substrate 120, 220, 320, 420, 520, 620 could be an additional organic laminate substrate. The additional organic laminate substrate for the second substrate could be similar to the organic laminate substrate for the first substrate. That is, it could have essentially the same layers (including a core and build up layer). Alternatively, the additional organic laminate substrate for the second substrate could be different from the organic laminate substrate for the first substrate. For example, the additional laminate substrate for the second substrate could have a core with glass fiber reinforcement, could be coreless, etc. In some embodiments, the maximum thickness of the first substrate can be greater than the maximum thickness of the second substrate.

The second side 119.2, 219.2, 319.2, 419.2, 519.2, 619.2 of the first substrate 110, 210, 310, 410, 510, 610 can be adhered to the first side 129.1, 229.1, 329.1, 429.1, 529.1, 629.1 of the second substrate 120, 220, 320, 420, 520 by an adhesive 199, 299, 399, 499, 599, 699. The adhesive can be, for example, an epoxy adhesive. Such an epoxy adhesive can be either a screen-printed epoxy adhesive or a flow-on epoxy adhesive (as discussed in greater detail below with regard to the methods).

The microelectronics package 100, 200, 300, 400, 500, 600 can further include one or more integrated circuit chips (also referred to herein as chips or dies) and one or more multi-element antennas. Specifically, some embodiments of the microelectronics package 100, 200, 300 can include a single chip 150, 250, 350, whereas other embodiments of the microelectronics package 400, 500, 600 can include multiple chips 450(1)-450(2), 550(1)-550(2), 650(1)-650(2). In any case, the chip(s) 150, 250, 350, 450(1)-450(2), 550(1)-550(2), 650(1)-650(2) can be mounted onto the first side 119.1, 219.1, 319.1, 419.1, 519.1, 619.1 of the first substrate 110, 210, 310, 410, 510, 610 using, for example, solder balls 151, 251, 351, 451, 551, 651 (as illustrated), copper pillars, wire bond interconnections, or any other suitable interconnect structure for mounting chips on carriers.

The microelectronics package 100, 200, 300, 400, 500, 600 can further include one or more multi-element antennas (i.e., one or more antennas with stacked antenna elements). Specifically, some embodiments of the microelectronics package 100, 200, 300 can include a single multi-element antenna 130, 230, 330 electrically connected to a single chip 150, 250, 350. Other embodiments of the microelectronics package 400, 500, 600 can include multiple multi-element antennas electrically connected to each of the chips 450(1)-450(2), 550(1)-550(2), 650(1)-650(2) and (see the two multi-element antennas 430*a*-430*b* connected to the chip 450(1) and the two multi-element antennas 430*c*-430*d* connected to the chip 450(2) in the microelectronics package 400 of FIGS. 4A-4F; see the two multi-element antennas 530*a*-530*b* connected to the chip 550(1) and the two multi-element antennas 530*c*-530*d* connected to the chip 550(2) in the microelectronics package 500 of FIGS. 5A-5E; and see the two multi-element antennas 630*a*-630*b* connected to the chip 650(1) and the two multi-element antennas 630*c*-630*d* connected to the chip 650(2) in the microelectronics package 600 of FIGS. 6A-6E).

It should be understood that the embodiments of the microelectronics package 100, 200, 300, 400, 500 and 600 described herein and shown in the drawings are provided for illustration purposes and are not intended to be limiting. Other microelectronics package embodiments could include different combinations of chip(s) and multi-element antenna (s). For example, some embodiments could include single chip with more than two multi-element antennas connected to the chip. Some embodiments could include multiple chips with more than two multi-element antennas connected to each chip. Some embodiments could include multiple chips, each connected to a single corresponding multi-element antenna. Some embodiments could include a single chip connected to multiple multi-element antennas. Still other embodiments could include multiple chips with first chip(s), each connected to only a single multi-element antenna, and with second chip(s), each connected to two or more multi-element antennas.

In any case, each multi-element antenna 130, 230, 330, 430*a*-430*d*, 530*a*-530*d*, 630*a*-630*d* can include a first antenna element 131, 231, 331, 431*a*-431*d*, 431*a*-531*d*, 631*a*-631*d* and a second antenna element 132, 232, 332, 432*a*-432*d*, 432*a*-532*d*, 632*a*-632*d*. These first and second antenna elements can be relatively thin, planar, metal pads. The metal pads for the two antenna elements can have the same shape. For example, the metal pads for the two antenna elements could be essentially square in shape (as illustrated). Alternatively, these metal pads could have any other suitable shape. For example, they could be rectangular, circular, ring-shaped, etc. In some embodiments, the metal pads for the two antenna elements can be, for example, copper pads. In some embodiments, the two antenna elements could be identical in size. In other embodiments, one of the two antenna elements could have a larger surface area than the other.

The first antenna element of each multi-element antenna can be on the second side of the first substrate. Specifically, see the first antenna element 131 of the multi-element antenna 130 on the second side 119.2 of the first substrate 110. See the first antenna element 231 of the multi-element antenna 230 on the second side 219.2 of the first substrate 210. See the first antenna element 331 of the multi-element antenna 330 on the second side 319.2 of the first substrate 310. See the first antenna elements 431*a*-431*d* of the multi-element antennas 430*a*-430*d*, respectively, on the second side 419.2 of the first substrate 410. See the first antenna elements 531*a*-531*d* of the multi-element antennas 530*a*-530*d*, respectively, on the second side 519.2 of the first substrate 510. See the first antenna elements 631*a*-631*d* of the multi-element antennas 630*a*-630*d*, respectively, on the second side 519.2 of the first substrate 510. Thus, each first antenna element is covered by and adjacent to the first side 129.1, 229.1, 329.1, 429.1, 529.1, 629.1 of the second substrate 120, 220, 320, 420, 520, 620, which, as mentioned above, is adhered to the second side 119.2, 219.2, 319.2, 419.2, 519.2, 619.2 of the first substrate 110, 210, 310, 410, 510, 610.

The first antenna element of each multi-element antenna can further be electrically connected by a metal interconnect structure (see discussion below) to a chip, which is mounted on the first side of the first substrate. Specifically, see the first antenna element 131 of the multi-element antenna 130 that is electrically connected by the metal interconnect structure 133 to the chip 150. See the first antenna element 231 of the multi-element antenna 230 that is electrically connected by the metal interconnect structure 233 to the chip 250. See the first antenna element 331 of the multi-element antenna 330 that is electrically connected by the metal interconnect structure 333 to the chip 350. See the first antenna elements 431*a*-431*b* of the multi-element antennas 430*a*-430*b*, respectively, that are electrically connected by the metal interconnect structures 433*a*-433*b*, respectively, to the first chip 450(1) and the first antenna elements 431*c*-431*d* of the multi-element antennas 430*c*-430*b*, respectively, that are electrically connected by the metal interconnect structures 433*c*-433*d*, respectively, to the to the second chip 450(2). See the first antenna elements 531*a*-531*b* of the multi-element antennas 530*a*-530*b*, respectively, that are electrically connected by the metal interconnect structures 533*a*-533*b*, respectively, to the first chip 550(1) and the first antenna elements 531*c*-431*d* of the multi-element antennas 530*c*-530*b*, respectively, that are electrically connected by the metal interconnect structures 533*c*-533*d*, respectively, to the to the second chip 550(2). See the first antenna elements 631*a*-631*b* of the multi-element antennas 630*a*-630*b*, respectively, that are electrically connected by the metal interconnect structures 633*a*-633*b*, respectively, to the first chip 650(1) and the first antenna elements 631*c*-631*d* of the multi-element antennas 630*c*-630*b*, respectively, that are electrically connected by the metal interconnect structures 633*c*-633*d*, respectively, to the to the second chip 650(2).

Each of the above-described metal interconnect structures 133, 233, 333, 433*a*-433*d*, 533*a*-533*d*, 633*a*-633*d* can extend through the first substrate 110, 210, 310, 410, 510, 610 so as to enable communication between the chip(s) 150, 250, 350, 450(1)-450(2), 550(1)-550(2), 650(1)-650(2) on the first side 119.1, 219.1, 319.1, 419.1, 519.1, 619 of the first substrate 110, 210, 310, 410, 510, 610 and the first antenna element(s) 131, 231, 331, 431*a*-431*d*, 531*a*-531*d*, 631*a*-631*d* on the second side 119.2, 219.2, 319.2, 419.2, 519.2, 619.2 of that first substrate. It should be noted that these metal interconnect structures could be plated-through-vias that extend essentially vertically through the first substrate (e.g., see the metal interconnect structures 133, 233, 433). Alternatively, the metal interconnect structures could include a combination of vias and wires, which are formed in the layers of the first substrate in order to make the required electrical connections (e.g., see the metal interconnect structures 433*a*-433*d*, 533*a*-533*d*, 633*a*-633*d*).

The second antenna element of each multi-element antenna can be on the second side of the second substrate, can overlay the first antenna element for that multi-element antenna (e.g., can be center aligned above the first antenna element for that multi-element antenna) and can be physically separated from the first antenna element by a relatively short distance such that it is parasitically coupled to the first antenna element. Specifically, see the second antenna element 132 of the multi-element antenna 130, which is on the second side 129.2 of the second substrate 120, which overlays the first antenna element 131 for that same multi-element antenna 130 and which is physically separated from and parasitically coupled to the first antenna element 131. See the second antenna element 232 of the multi-element antenna 230, which is on the second side 229.2 of the second substrate 220, which overlays the first antenna element 231 for that same multi-element antenna 230 and which is physically separated from and parasitically coupled to the first antenna element 231. See the second antenna element 332 of the multi-element antenna 330, which is on the second side 329.2 of the second substrate 320, which overlays the first antenna element 331 for that multi-element antenna 330 and which is physically separated from and parasitically coupled to the first antenna element 331. See the second antenna elements 432*a*-432*d* of the multi-element antennas 430*a*-430*d*, which are on the second side 429.2 of the second substrate 420, which overlay the first antenna elements 431*a*-431*d* for those multi-element antennas 430*a*-430*d*, respectively, and which are physically separated from and parasitically coupled to the first antenna elements 431*a*-431*d*. See the second antenna elements 532*a*-532*d* of the multi-element antennas 5530*a*-530*d*, which are on the second side 529.2 of the second substrate 520, which overlay the first antenna elements 531*a*-531*d* for those multi-element antennas 530*a*-530*d*, respectively, and which are physically separated from and parasitically coupled to the first antenna elements 531*a*-531*d*. See the second antenna elements 632*a*-632*d* of the multi-element antennas 630*a*-630*d*, which are on the second side 629.2 of the second substrate 620, which overlay the first antenna elements 631*a*-631*d* for those multi-element antennas 630*a*-630*d*, respectively, and which are physically separated from and parasitically coupled to the first antenna elements 631*a*-631*d*.

As mentioned above, the second antenna element of each multi-element antenna is physically separated from the first antenna element. In addition, the space between the first and second elements of any given multi-element antenna includes at least one ultra-low-K dielectric region. Each of the ultra-low-K dielectric regions described below can include a trench (also referred to herein as a cavity), which extends some distance into one of the substrates from either the first side (i.e., the bottom side) or the second side (i.e., the top side) as specified below and which contains an ultra-low-K dielectric material.

In some embodiments, each multi-element antenna can include an ultra-low-K dielectric region within the second substrate on the first side so as to be between the first and second antenna elements of the antenna. For example, in the microelectronics package 100, the second substrate 120 includes an ultra-low-K dielectric region 135. This ultra-low-K dielectric region 135 includes a trench 136 (also referred to herein as a cavity), which contains an ultra-low-K dielectric material 137. That is, the ultra-low-K dielectric region 135 is a dielectric-containing trench. The trench 136 extends from the first side 129.1 of the second substrate 120 adjacent to the first antenna element 131 of the antenna 130 (which is on the second side 119.2 of the first substrate 110) toward the second antenna element 132 of the antenna 130 at the second side 129.2 of the second substrate 120 without extending completely through the second substrate 120. Thus, the ultra-low-K dielectric region 135 within the second substrate 120 and a thin portion of the second substrate are aligned with and between the first antenna element 131 and the second antenna element 132.

Similarly, in the microelectronics package 400, the second substrate 420 includes multiple ultra-low-K dielectric regions 435*a*-435*d*. Each ultra-low-K dielectric region 435*a*-435*d* includes a trench 436 (also referred to herein as a cavity), which contains an ultra-low-K dielectric material 437. That is, the ultra-low-K dielectric regions 435*a*-435*d* are dielectric-containing trenches. The trenches 436 extend from the first side 429.1 of the second substrate 420 adjacent to first antenna elements 431*a*-431*d* of the antennas 430*a*-430*d*, respectively (which are on the second side 419.2 of the first substrate 410) toward the second antenna elements 432*a*-432*d* at the second side 429.2 of the second substrate 420 without extending completely through the second substrate 420. Thus, an ultra-low-K dielectric region within the second substrate 420 and a thin portion of the second substrate 420 are aligned with and between the first and second antenna elements of each antenna.

In other embodiments, each multi-element antenna can include an ultra-low-K dielectric region within the first substrate on the second side so as to be between the first and second antenna elements of the antenna. For example, in the microelectronics package 200, the first substrate 210 includes an ultra-low-K dielectric region 235. This ultra-low-K dielectric region 235 includes a trench 236 (also referred to herein as a cavity), which contains an ultra-low-K dielectric material 237. That is, the ultra-low-K dielectric region 235 is a dielectric-containing trench. The trench 236 extends from the second side 219.2 of the first substrate 210 toward the first side 219.2 of the first substrate 210. In this case, the first antenna element 231 can be positioned at the bottom of trench 236 covered by the dielectric material 237. Thus, the ultra-low-K dielectric region 235 and the full thickness of the second substrate 220 are between the first antenna element 231 and the second antenna element 232.

Similarly, in the microelectronics package 500, the first substrate 510 includes multiple ultra-low-K dielectric regions 535*a*-535*d*. Each ultra-low-K dielectric region 535*a*-535*d* includes a trench 536 (also referred to herein as a cavity), which contains an ultra-low-K dielectric material 537. That is, the ultra-low-K dielectric regions 535*a*-535*d* are dielectric-containing trenches. The trenches 536 extend from the second side 519.2 of the first substrate 510 toward the first side 519.2 of the first substrate 510. In this case, the first antenna elements 531*a*-531*d* of the antennas 530*a*-530*d*, respectively, can be positioned at the bottom of trenches 536 and covered by the dielectric material 537. Thus, an ultra-low-K dielectric region and the full thickness of the second substrate 520 are between the first and second antenna elements of each of the antennas 530*a*-530*d*.

In still other embodiments, each multi-element antenna can include multiple low-K dielectric regions (e.g., on in the first substrate at the second side and another in the second substrate at the first side) between the first and second elements of the antenna. For example, in the microelectronics package 300, the first substrate 310 includes a first ultra-low-K dielectric region 335(1). This first ultra-low-K dielectric region 335(1) includes a first trench 336(1) (also referred to herein as a first cavity), which contains a first ultra-low-K dielectric material 337(1). That is, the first ultra-low-K dielectric region 335(1) is a first dielectric-containing trench. The first trench 336(1) extends from the second side 319.2 of the first substrate 310 toward the first side 319.2 of the first substrate 310. In this case, the first antenna element 331 can be positioned at the bottom of first trench 336(1) covered by the first dielectric material 337(1). Additionally, in this microelectronics package 300, the second substrate 320 can include a second ultra-low-K dielectric region 335(2) adjacent to the first ultra-low-K dielectric region 335(1). This second ultra-low-K dielectric region 335(2) can include a second trench 336(2) (also referred to as a second cavity), which contains a second ultra-low-K dielectric material 337(2). That is, the second ultra-low-K dielectric region 335(2) is a second dielectric-containing trench. This second trench 336(2) can extend from the first side 329.1 of the second substrate 320 adjacent to the first ultra-low-K dielectric region 335(1) (which is in the second side 319.2 of the first substrate 310) toward the second antenna element 332 of the antenna 330 at the second side 329.2 of the second substrate 320 without extending completely through the second substrate 320. Thus, the first ultra-low-K dielectric region 335(1), the second ultra-low-K dielectric region 335(2) and a thin portion of the second substrate 320 are aligned with and between the first antenna element 331 and the second antenna element 332 of the antenna 330.

Similarly, in the microelectronics package 600, the first substrate 610 includes first ultra-low-K dielectric regions 635*a*(1)-635*d*(1). These first ultra-low-K dielectric regions include first trenches 636(1) (also referred to herein as first cavities), which contain a first ultra-low-K dielectric material 637(1). That is, the first ultra-low-K dielectric regions 635*a*(1)-635*d*(1) are first dielectric-containing trenches. The first trenches 636(1) extend from the second side 619.2 of the first substrate 610 toward the first side 619.2 of the first substrate 610. In this case, the first antenna elements 631*a*-631*d* can be positioned at the bottoms of first trenches 636(1) covered by the first dielectric material 637(1). Additionally, in this microelectronics package 600, the second substrate 620 can include second ultra-low-K dielectric regions 635*a*(2)-635*d*(2) adjacent to the first ultra-low-K dielectric regions 635*a*(1)-635*d*(1), respectively. These second ultra-low-K dielectric regions 635*a*(2)-635*d*(2) can include second trenches 636(2) (also referred to herein as second cavities), which contain a second ultra-low-K dielectric material 637(2). That is, the second ultra-low-K dielectric regions 635*a*(2)-635*d*(2) are second dielectric-containing trenches. These second trenches 636(2) can extend from the first side 629.1 of the second substrate 620 adjacent to the first ultra-low-K dielectric regions 635*a*(1)-635*d*(1), respectively (which are in the second side 619.2 of the first substrate 610) toward the second antenna elements 332*a*-332*d* of the antennas 630*a*-630*d* at the second side 629.2 of the second substrate 620 without extending completely through the second substrate 620. Thus, a first ultra-low-K dielectric region 635*a*(1)-635*d*(1), a second ultra-low-K dielectric region 635*a*(2)-635*d*(2) and a thin portion of the second substrate 620 are aligned with and between the first antenna element 631*a*-631*d* and the second antenna element 632*a*-632*d* of each antenna 630*a*-630*d*, respectively.

As mentioned above, the ultra-low-K dielectric region(s) 135, 235, 335(1)-335(2), 435*a*-435*d*, 535*a*-535*d*, 635*a*(1)-635*d*(1) and 635*a*(2)-635*d*(2) in each microelectronics package is/are dielectric-containing trench(es) (i.e., trench(es) that contain ultra-low-K dielectric material 137, 237, 337(1)-337(2), 437, 537, 637(1) and 637(2)). For purposes of this disclosure, an ultra-low-K dielectric material refers to a dielectric material that has a dielectric constant that is no greater than 2.5. Exemplary ultra-low-K dielectric materials include air (K−1), a fluoropolymer such as Teflon® (K−2) and a porous fluoropolymer (1<K<2). These exemplary ultra-low-K dielectric materials are not intended to be limiting. Alternatively, any other suitable ultra-low-K dielectric material could be incorporated into the micro-electronics structure. Alternatively, the trench(es) of the ultra-low-K dielectric region(s) in each microelectronics package could be under vacuum.

It should be noted that the first and second dielectric materials 337(1)-337(2), 637(1)-637(2) in the microelectronics package 300, 600 can be the same dielectric material (e.g., air, a fluoropolymer, a porous fluoropolymer, etc.). Alternatively, the first and second dielectric materials 337(1)-337(2), 637(1)-637(2) in the microelectronics package 300, 600 could be dielectric materials (e.g., any combination of the above-mentioned ultra-low-K dielectric materials). It should also be noted that the size(s) of the ultra-low-K dielectric region(s) in the microelectronics packages 100, 200, 300, 400, 500, 600 (i.e., the size(s) of the trench(es) including the length, width and height) and the size(s) of the first and second antenna elements of each antenna can predetermined by designers to optimize the bandwidth of the antenna for a given application.

For example, consider the microelectronics package 100. The dimensions of the second substrate 120, the dimensions of the ultra-low-K dielectric region 135 within the second substrate 120, and the dimensions of the first antenna element 131 and the second antenna element 132 can all be predetermined so that the bandwidth of a multi-element antenna 130 is suitable for 5G operation (e.g., so that the bandwidth includes the 28 GHz bands). To achieve a multi-element antenna 130 with a bandwidth that includes the 28 GHz, the microelectronics package 100 could be configured as follows: (a) a second substrate 120 with a length of 5.36 mm, a width of 5.36 mm and a height (or thickness) of 0.44 mm; (b) a trench 136 for an ultra-low-K dielectric region 135, which is centered on the first side of the second substrate 120 and which has a length of 4.0 mm, a width of 4.0 mm, and a height (or depth) of 0.24 mm such that the second antenna element 132 is separated from the trench by a thin portion of the second substrate (e.g., a 0.20 mm portion) and such that vertical sidewalls of the second substrate are separated from the vertical sidewalls of the trench by a distance of 0.68 mm; and (c) antenna elements 131 and 132, which are center-aligned with each other and with the trench 136 and which each have a length of 2.9 mm, a width of 2.9 mm and a height (or thickness) of 0.5 mm or less.

In any case, the area of each trench (i.e., the length and width of the trench in a horizontal plane that is parallel with the top and bottom surfaces of the substrates) for each ultra-low-K dielectric region in each of the embodiments can be relatively large, as compared to the area of each antenna element above and below the ultra-low-K dielectric region. Additionally, the remaining area of the substrate laterally surrounding each trench for each ultra-low-K dielectric region should be sufficiently large to provide structural support for the substrate.

The above-described microelectronics package embodiments are not intended to be limiting. In addition to the specific features discussed above, each of the microelectronics package embodiment may optionally one or more additional features in the first substrate and/or in the second substrate.

Figure 7A:
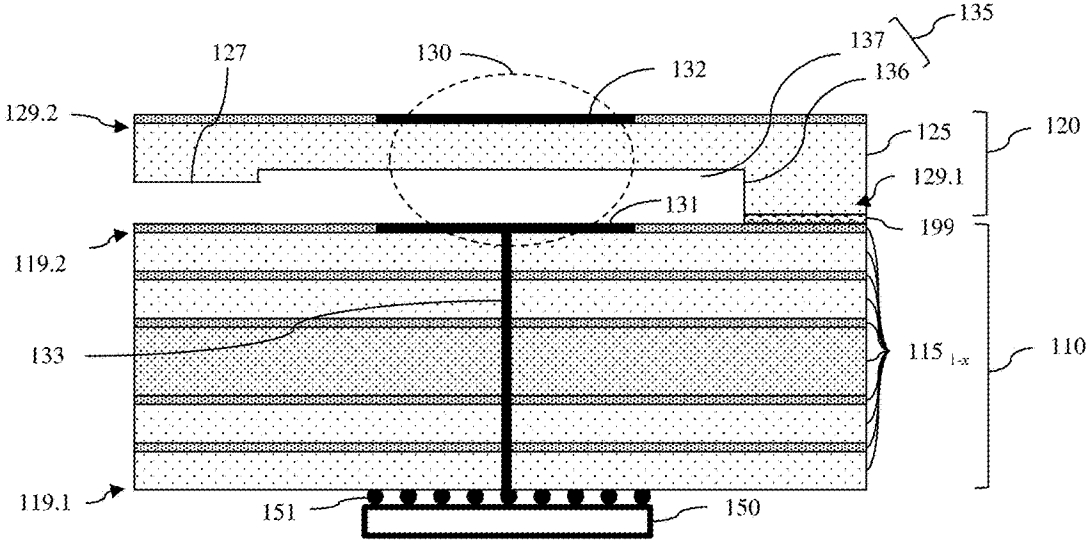
FIGS. 7A-7C are cross-section diagrams illustrating exemplary vent configurations for the second substrate that could be incorporated into the disclosed microelectronics package embodiments.
Figure 7B:
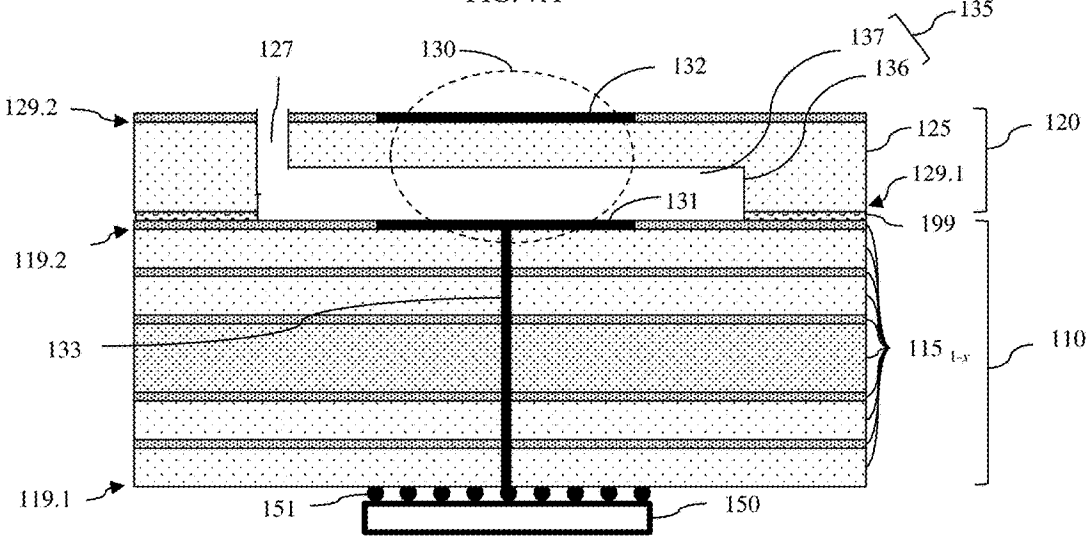
Figure 7C:
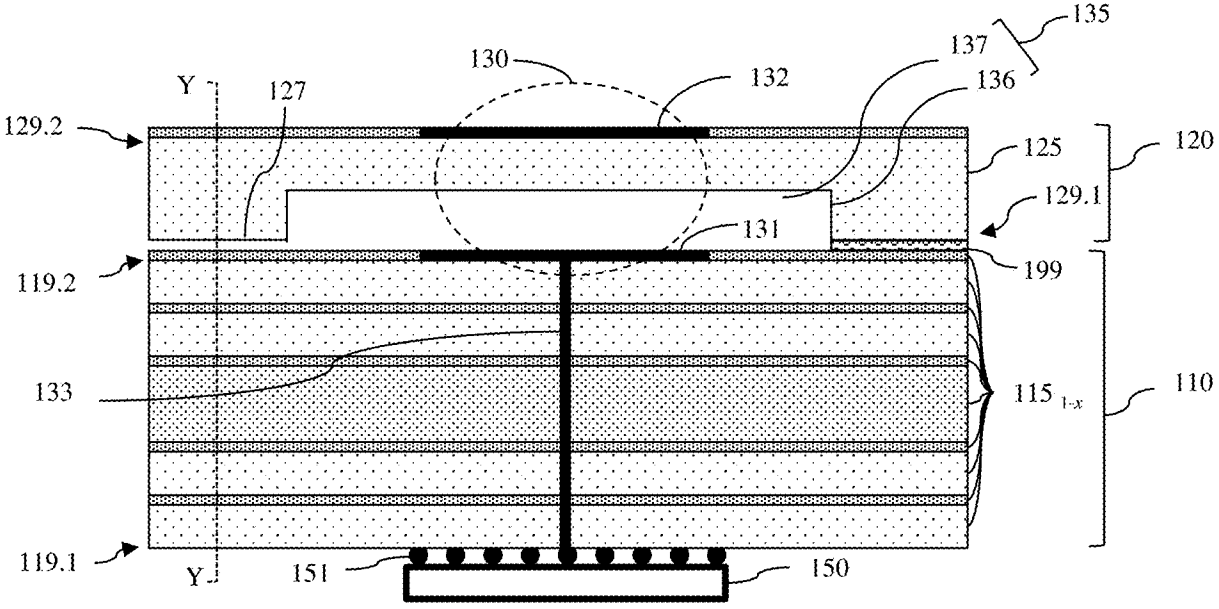
Figure 8A:
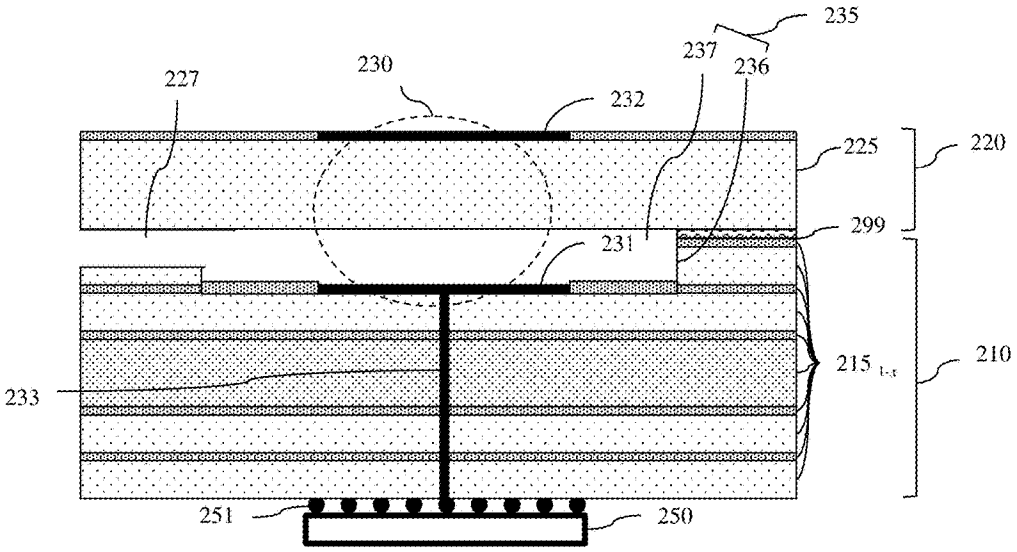
FIGS. 8A-8C are cross-section diagrams illustrating exemplary vent configurations for the first substrate that could be incorporated into the disclosed microelectronics package embodiments.
Figure 8B:
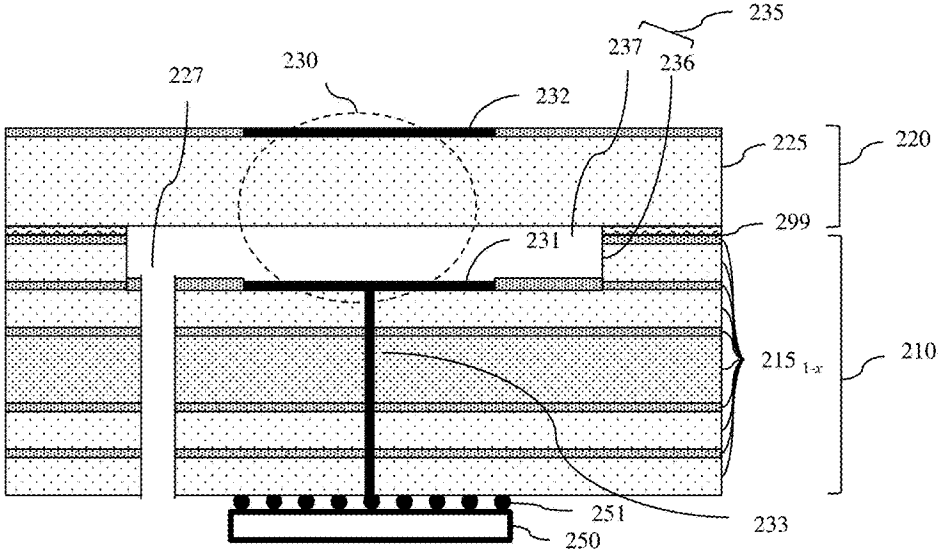
Figure 8C:
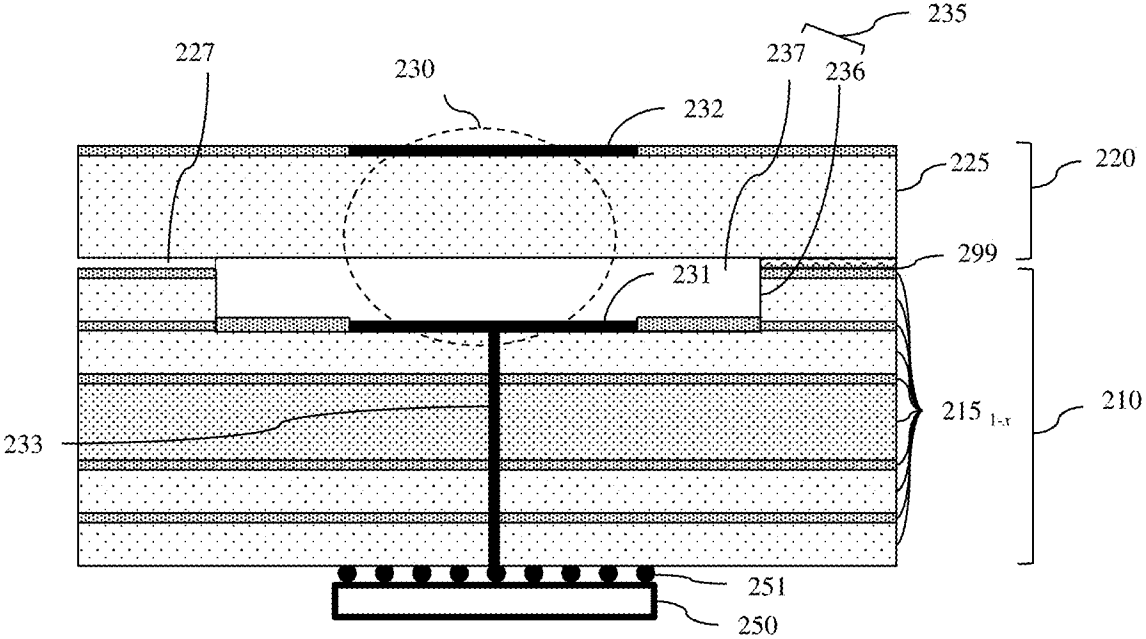

For example, optionally, in some embodiments and, particularly, in embodiments where the ultra-low-K dielectric region(s) is/are air-containing trench(es), the trench(es) can be vented in order to allow air to circulate into and out of the trench(es) and, thereby to minimize moisture build up within the trench(es). FIGS. 7A-7C illustrate exemplary configurations for a vent 127 for the trench 136 in the second substrate 120 of the microelectronics package 100 described above. Specifically, the vent 127 could, for example, be any of the following: a groove that extends laterally from the trench 136 to a sidewall of the second substrate 120 (see FIG. 7A), a hole that extends from vertically from the trench 136 to the second side 129.2 of the second substrate 120 (see FIG. 7B), or a gap in the adhesive 199 used to adhere the second substrate 120 onto the first substrate 110 (see FIG. 7C). It should be understood that similar vent configurations could be employed for the trenches 336(2), 436*a-d* and 636(2)*a-d* in the second substrates 320, 420 and 620 of the microelectronics packages 300, 400, and 600 described above. FIGS. 8A-8C illustrate exemplary configurations for a vent 227 for the trench 236 in the first substrate 210 of the microelectronics package 200 described above. Specifically, the vent 227 could, for example, be any of the following: a groove that extends laterally from the trench 236 to a sidewall of the first substrate 210 (see FIG. 8A), a hole that extends from vertically from the trench 236 to the first side 219.1 of the first substrate 210 (see FIG. 8B), or a gap in the adhesive 299 used to adhere the second substrate 220 onto the first substrate 210 (see FIG. 8C). It should be understood that similar vent configurations could be employed for the trenches 336(1), 536*a-d* and 636(1)*a-d* in the first substrates 310, 510 and 610 of the microelectronics packages 300, 500, and 600 described above. It should further be understood that the vent configurations described above and illustrated in FIGS. 7A-7C and 8A-8C are not intended to be limiting. Alternatively, any other suitable means of venting air-containing trench(es) in the first substrate and/or the second substrate could be employed.

Figure 9A:
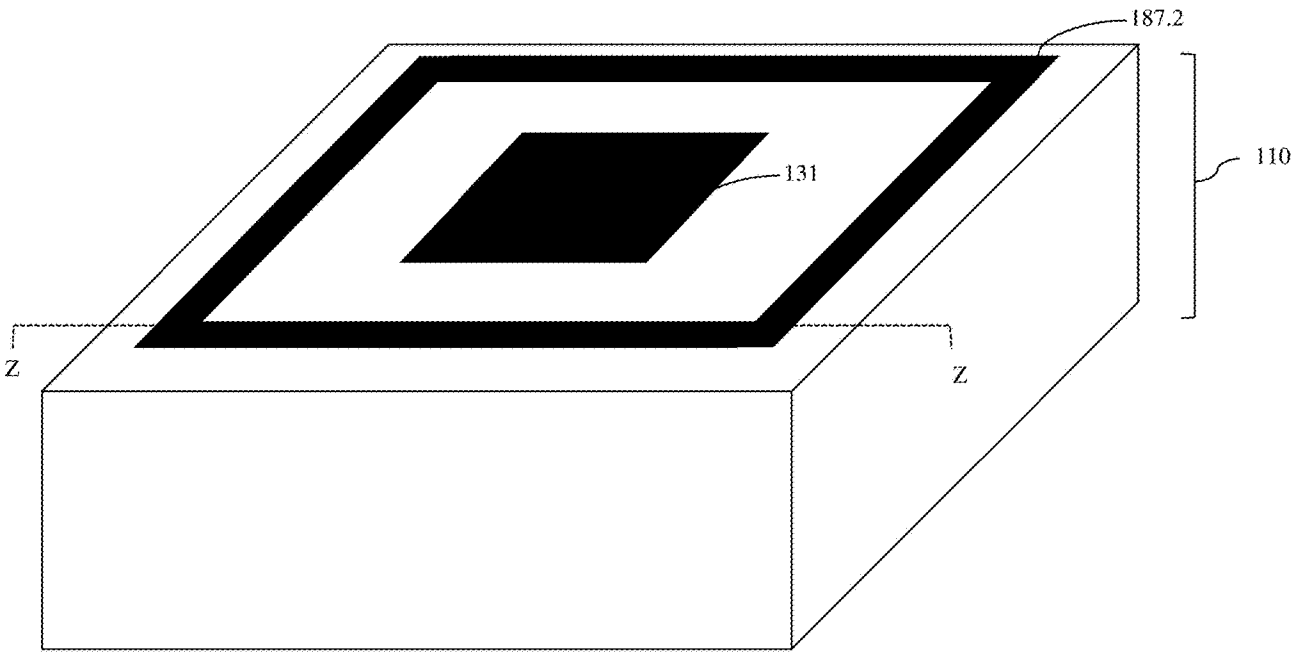
FIG. 9A is a perspective view drawing and FIG. 9B is a cross-section drawing of a first substrate, which includes ground rings and vias between the ground rings and which could be incorporated into the disclosed microelectronics package embodiments.
Figure 9B:
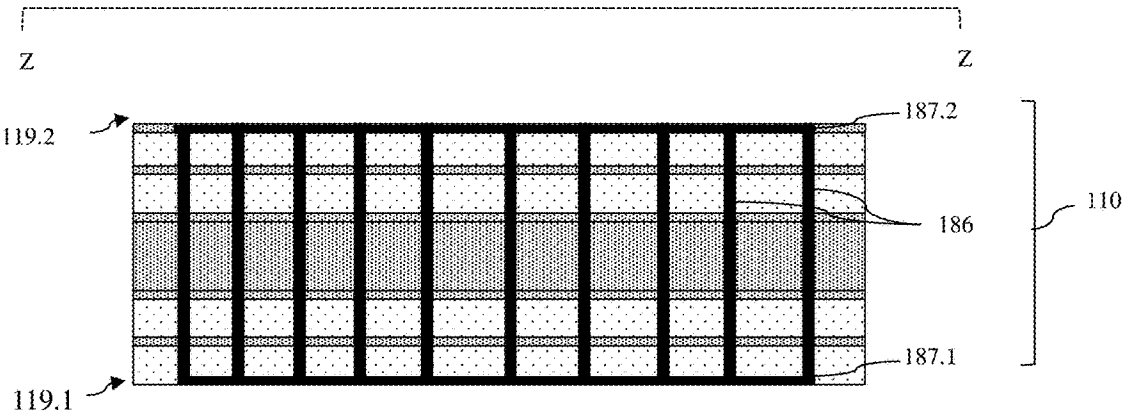
Figure 10A:
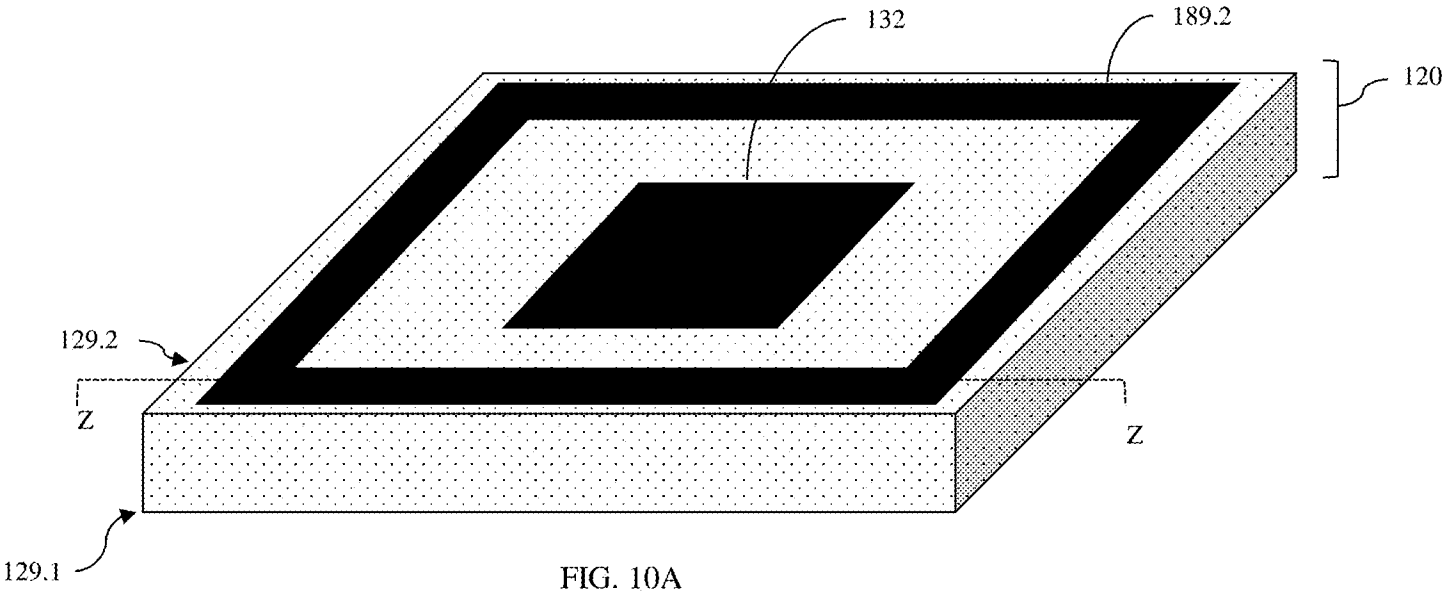
FIG. 10A is a perspective view drawing and FIG. 10B is a cross-section drawing of a second substrate, which includes ground rings and vias between the ground rings and which could be incorporated into the disclosed microelectronics package embodiments.
Figure 10B:
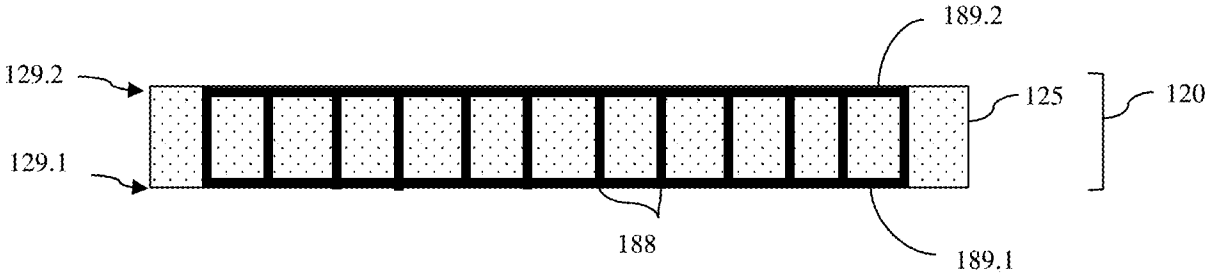

Optionally, in some embodiments, one or both of the substrates in the microelectronics packages disclosed herein can include a pair of ground rings and vias that electrically connect the ground rings. For example, optionally, in the microelectronics package 100, the first substrate 110 can include first and second ground rings 187.1 and 187.2 on the first and second sides 119.1 and 119.2, respectively, and vias 186 that extend essentially vertically through the first substrate 110 to electrically connect the first and second ground rings (as shown in FIGS. 9A-9B). Also, optionally, in the microelectronics package 100, the second substrate 120 can include first and second ground rings 189.1 and 189.2 on the first and second sides 129.1 and 129.2, respectively, and vias 188 that extend essentially vertically through the second substrate 120 in order to electrically connect the first and second ground rings (as shown in FIGS. 10A-10B). Additionally, in embodiments where the microelectronics package includes pairs of ground rings on both the first substrate and the second substrate, the adhesive that adheres the first substrate to the second substrate can be a conductive epoxy adhesive that also electrically connects the ground rings on the two substrates (e.g., the second ground ring 187.2 on the first substrate 110 to the first ground ring 189.1 on the second substrate 120). An exemplary conductive adhesive that could be used is an epoxy adhesive that includes metal particles such as silver particles. It should be understood that similar pairs of guard rings with connecting vias could be incorporated into the first substrate and/or the second substrate of the microelectronics packages 200, 300, 400, 500 and 600. Additionally, in the microelectronics packages 400-600, the guard rings could be multi-section guard rings with each section bordering a corresponding antenna.

Figure 11:
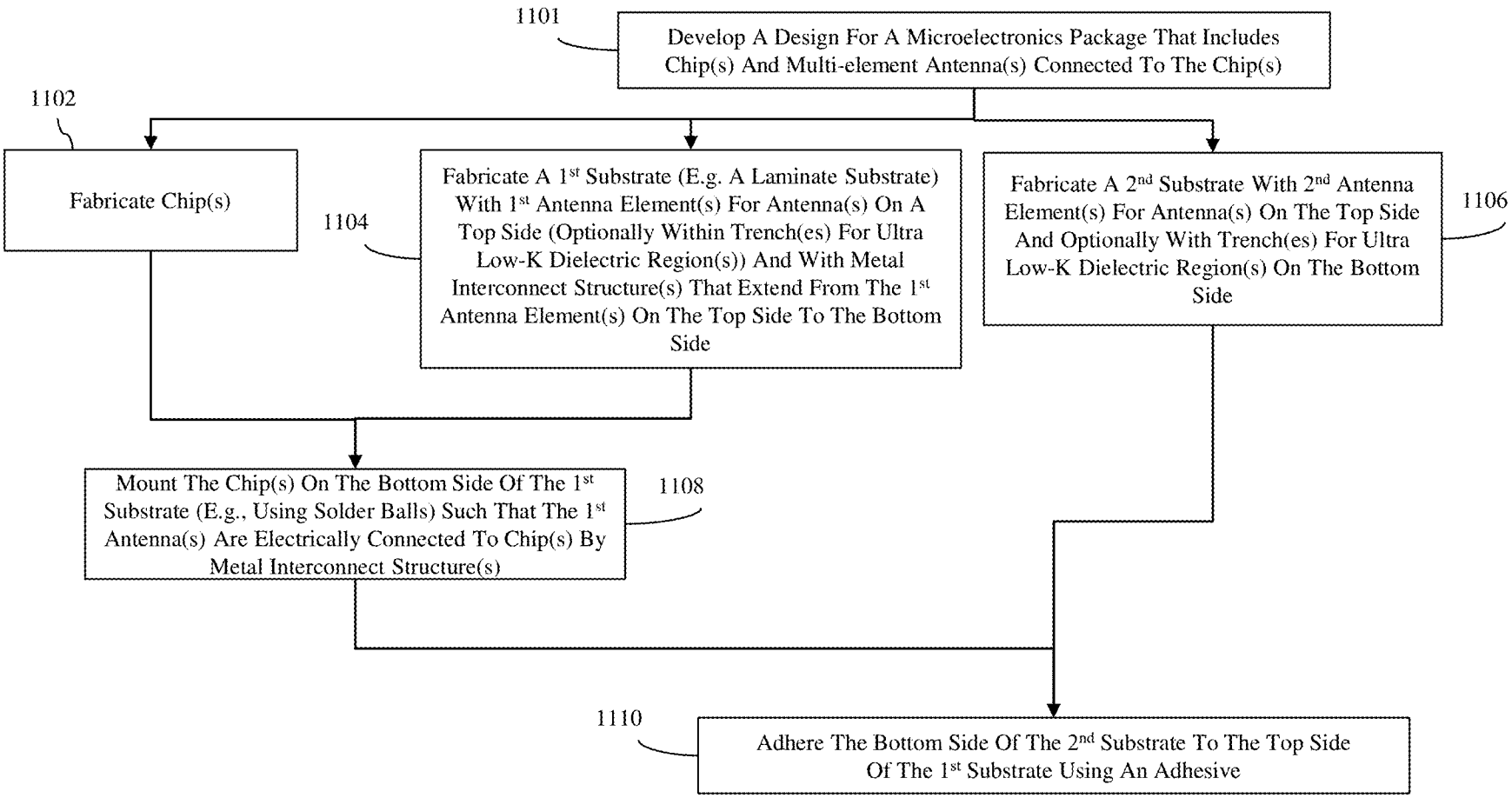
FIG. 11 is a flow diagram illustrating method embodiments for forming the disclosed microelectronics package embodiments.

Also disclosed herein are method embodiments for forming the above-described microelectronics packages. Referring to the flow diagram of FIG. 11, process steps 1101-1110 can be performed so as to form a microelectronics package, which incorporates one or more chips and one or more multi-element antennas (i.e., antennas with stacked antenna elements) connected to each chip. That is, the process steps 1101-1110 can be performed so as to form a microelectronics package that includes any of the following: a single chip connected to a single multi-element antenna (such as any of the microelectronics packages 100, 200, 300 described in detail above and illustrated in FIGS. 1A-1C, 2A-2B, 3A-3B); a single chip connected to multiple multi-element antennas; multiple chips connected to multi-element antennas, respectively; or multiple chips, each connected to multiple multi-element antennas (such as any of the microelectronics packages 100, 200, 300, 400, 500, and 600 described in detail above and illustrated in FIGS. 1A-1C, 2A-2B, 3A-3B, 4A-4F, 5A-5E and 6A-6E).

Specifically, the method embodiments can include developing a design for a microelectronics package that incorporates one or more chips and one or more multi-element antennas connected to each chip (see process step 1101). The method embodiments can further include fabricating the one or more chip(s) according to the design (see process step 1102). The method embodiments can further include fabricating a first substrate (e.g., a laminate substrate) for the microelectronics package according to the design (see process step 1104). The method embodiments can further include fabricating a second substrate (e.g., a polymer layer) for the microelectronics package according to the design (see process step 1106). The first substrate and the second substrate can each have a first side (e.g., a bottom side) and a second side (e.g., a top side) opposite the first side. The method embodiments can further include mounting the chip(s) on the first side of the first substrate (e.g., using solder balls, copper pillars, wire bond interconnections, or any other suitable interconnect structure for mounting chips on carriers) (see process step 1108). The method embodiments can further include adhering the second side of the first substrate to the first side of the second substrate using an adhesive (e.g., an epoxy adhesive) in order to form the microelectronics package (see process step 1110).

As discussed below the details of these process steps will vary depending upon microelectronics package being designed and formed. However, regardless of the microelectronics package being formed, process step 1104 of fabricating the first substrate can be performed so that, for each multi-element antenna, the first substrate includes a first antenna element on the second side of the first substrate and a metal interconnect structure that extends through the first substrate from the first antenna element on the second side to the first side. Process step 1106 of fabricating the second substrate can be performed so that, for each multi-element antenna, the second substrate includes a second antenna element on the second side of the second substrate. Process steps 1104 and/or process step 1106 can be performed so that, for each multi-element antenna, at least one ultra-low-K dielectric region (e.g., at least one ultra-low-K dielectric-containing trench) is formed within the first side of the second substrate and/or the second side of the first substrate. Process step 1108 of mounting the chip(s) on the first side of the first substrate can be performed so that each chip is by a metal interconnect structure to at least one first antenna element of at least one multi-element antenna. As discussed in detail above, in some embodiments, each chip may be electrically connected to only one first antenna element of only one multi-element antenna. In other embodiments, each chip may be connected to multiple first antenna elements of multiple multi-element antennas. Finally, process step 1110 of adhering the first side of the second substrate to the second side of the first substrate can be performed so that, for each multi-element antenna, the second antenna element for the multi-element antenna overlays the first antenna element (e.g., is above the first antenna element), is parasitically coupled to the first antenna element, and is physically separated from the first antenna element by an ultra-low-K dielectric region within the first side of the second substrate, an ultra-low-K dielectric region in the second side of the first substrate or both.

Figure 1B:
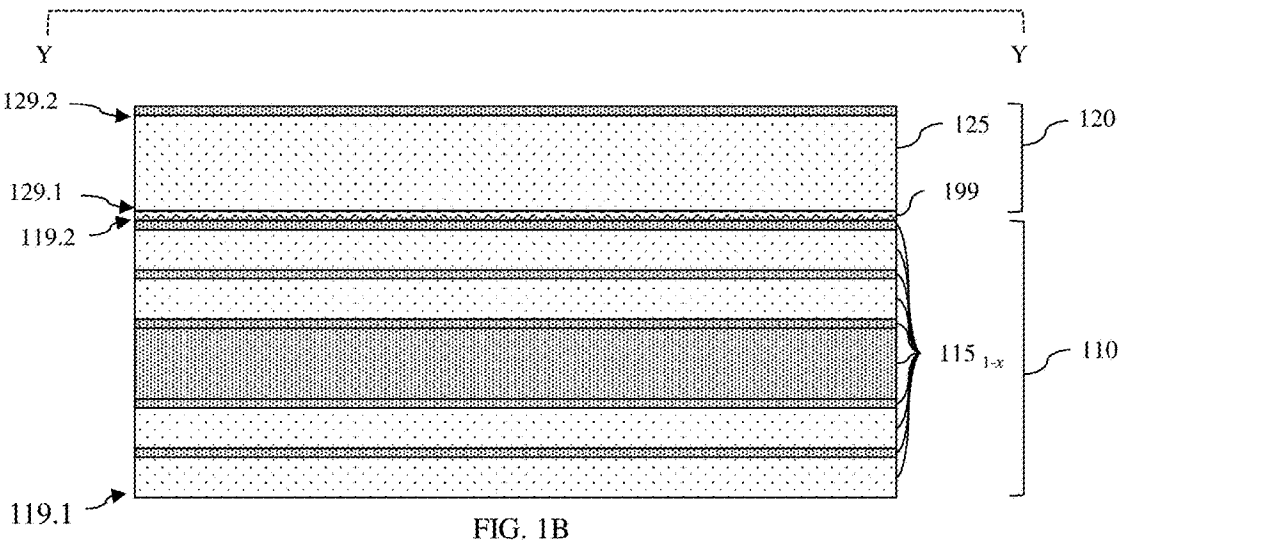
Figure 1C:
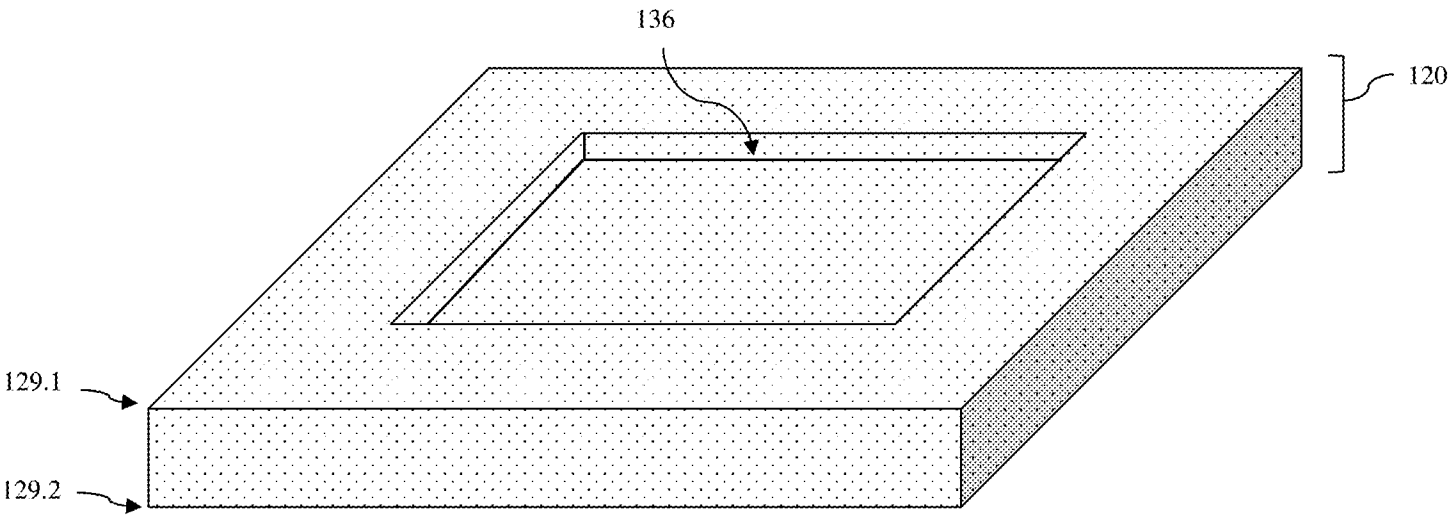
FIG. 1C is a perspective drawing illustrating second substrate.

More specifically, in one embodiment of the method, a design for a microelectronics package, such as the microelectronics package 100 of FIGS. 1A-1C could be developed (see process step 1101).

Figure 12A:
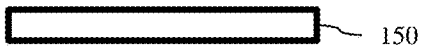
FIGS. 12A-12D are cross-section diagrams illustrating partially completed structures during formation of the microelectronics package shown in FIGS. 1A-1C according to the flow diagram of FIG. 11.

This method can include fabricating the chip 150 for the microelectronics package 100 according to the design (see process step 1102 and FIG. 12A).

Figure 12B:
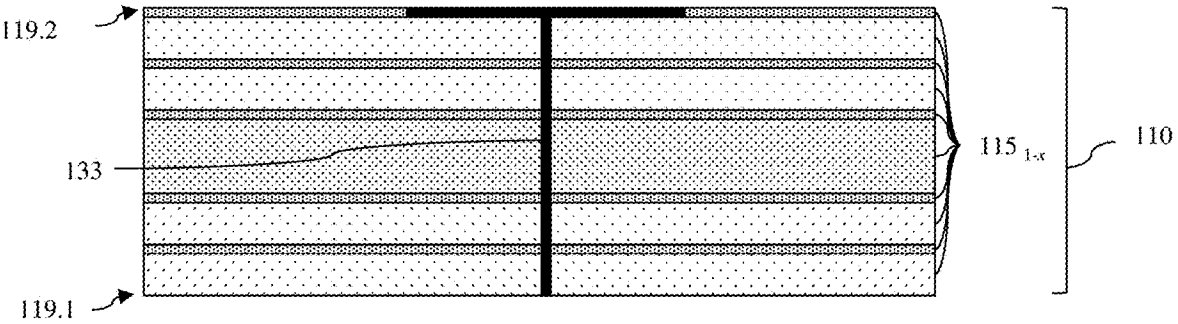

The method can further include fabricating a first substrate 110 for the microelectronics package 100 according to the design (see process step 1104 and FIG. 12B). As illustrated, the first substrate 110 can be fabricated as a laminate substrate that includes multiple thin organic layers $\mathbf{115}_{1-x}$ (e.g., of polymers, resins, etc.), a first side 119.1 (e.g., a bottom side) and a second side 119.2 (e.g., a top side) opposite the first side. During formation of the first substrate 110, a metal interconnect structure 133 (e.g., a TSV or a combination of vias and wires) can be formed such that it is embedded within the layers $\mathbf{115}_{1-x}$, extending from the first side 119.1 to the second side 119.2. Additionally, a first antenna element 131 (e.g., a metal pad, such as a copper pad) for a multi-element antenna 130 can be formed on the second side 119.2 of the first substrate 110 such that it is in contact with the metal interconnect structure 133.

Figure 12C:
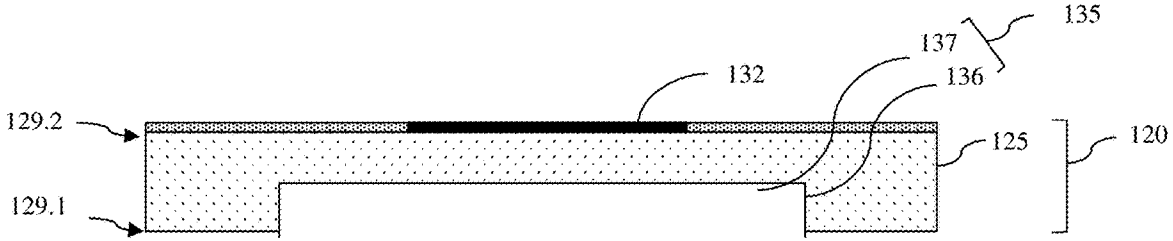
Figure 12C:
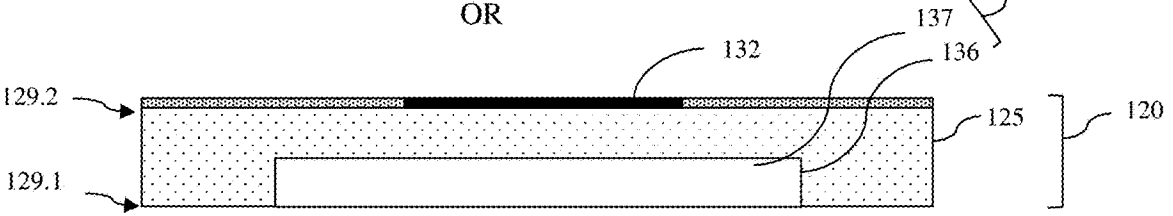

The method can further include fabricating a second substrate 120 for the microelectronics package 100 according to the design (see process step 1106 and FIG. 12C). As illustrated, the second substrate 120 can be fabricated so as to have an ultra-low-K dielectric region 135. This ultra-low-K dielectric region 135 can include a trench 136, which extends into the first side 129.1 (e.g., the bottom side) of the second substrate 120. It can also include an ultra-low-K dielectric material 137 in the trench 136. This second substrate 120 can further be fabricated so as to have a second antenna element 132 on the second side 129.2 aligned above and physically separated from the ultra-low-K dielectric region 135.

Exemplary steps for fabricating the second substrate 120 with the trench 136 and second antenna element 132 can include the following: providing a single polymer layer 125 with planar bottom surface and top surfaces; forming the second antenna element 132 on the top surface (e.g., using a plating process); and forming a trench 136 in the bottom surface (e.g., by mechanical milling, laser cutting, or laser drilling).

Alternative steps for fabricating the second substrate 120 with the trench 136 and second antenna element 132 can include the following: using an injection molding process with a liquid crystal polymer (LCP) to form a polymer layer 125 with a bottom surface, a trench 136 extending into the polymer layer from the bottom surface, and a planar top surface; and forming the second antenna element 132 on the top surface (e.g., using a plating process).

Alternative steps for fabricating the second substrate 120 could include forming an additional organic laminate substrate. The additional organic laminate substrate for the second substrate could be similar to the organic laminate substrate for the first substrate (e.g., could have essentially the same layers) or could be different from the organic laminate substrate for the first substrate. For example, the additional laminate substrate for the second substrate could be formed to have a core with glass fiber reinforcement, to be coreless, etc. Following formation of the additional organic laminate substrate, the trench 136 could be formed in the bottom surface (e.g., using lithographically patterning and etch processes, by mechanically milling, laser cutting, etc.) and the second antenna element 132 could be formed on the top surface (e.g., using a plating process).

In any case, the trench 136 in the second substrate 120 could be left empty (i.e., filled with air, which, as mentioned above, is an ultra-low-K dielectric material). If the trench 136 is to remain empty, then the process steps should also include formation a vent 127 for the trench 136 (e.g., see the exemplary vent 127 configurations shown in FIGS. 7A-7C, discussed in detail above, include a lateral vent in the second substrate 120, a vertical vent in the second substrate 120 or, at process step 1110, a gap in the adhesive 199 between the first and second substrates 110 and 120).

Figure 13A:
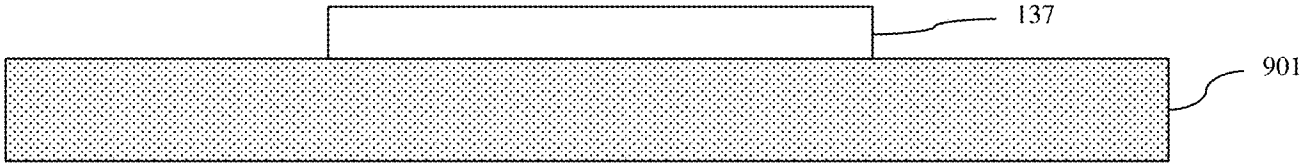
FIGS. 13A-13C are cross-section diagrams illustrating partially completed structures during formation of the second substrate with an optional fluoropolymer-filled trench in the microelectronics package shown in FIGS. 1A-1C according to the flow diagram of FIG. 11.
Figure 13B:
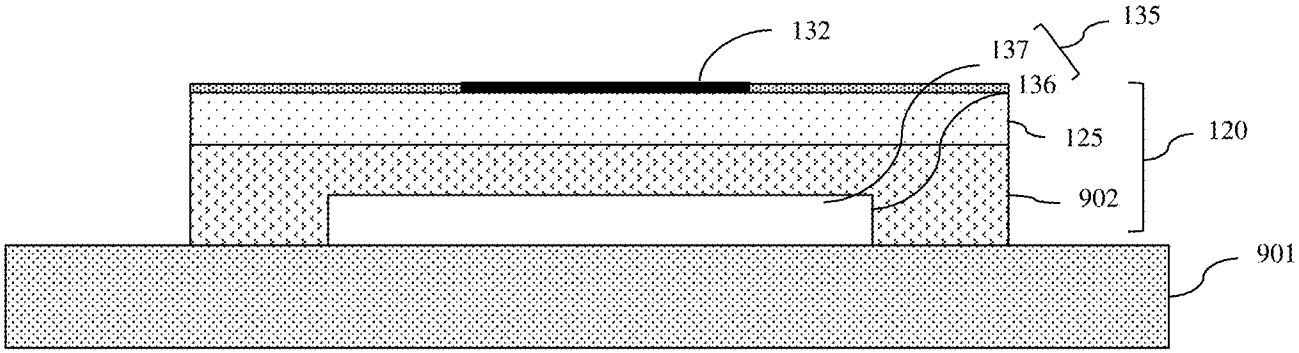
Figure 13C:
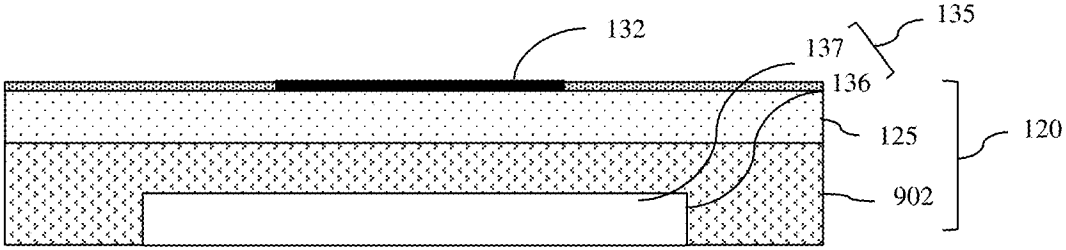

Alternatively, the trench 136 could be filled with a solid ultra-low-K dielectric material (e.g., a fluoropolymer such as Teflon® or a porous fluoropolymer) or any other suitable ultra-low-K dielectric material with a dielectric constant of 2.5 or less. However, those skilled in the art will recognize that adhering a fluoropolymer or the like to the trench surfaces can be difficult. Thus, still other steps for fabricating the second substrate 120, as described above, can include the following: placing a fluoropolymer pad (i.e., the dielectric material for the ultra-low-K dielectric region 135) on a carrier 901 (see FIG. 13A); covering the fluoropolymer pad with a molding layer 902 using a compression molding process (see FIG. 13B); forming a polymer layer 125 on the molding layer 902; forming the second antenna element 132 on the top surface of the polymer layer 125 (e.g., using a plating process) (see FIG. 13B); and selectively removing the carrier (see FIG. 13C).

It should be noted that the process steps described above are general and not intended to be limiting. Optionally, process step 1104 of fabricating the first substrate 110 and/or process step 1106 of fabricating the second substrate 120 can include forming additional features in or on the substrates. For example, process step 1104 and/or process step 1106 can also include forming a pair of ground rings opposite sides of the substrate and forming vias that extend through the substrate in order to electrically connect the ground rings. That is, optionally, at process step 1104 the first substrate 110 can be formed so as to have first and second ground rings 187.1 and 187.2 on the first and second sides 119.1 and 119.2, respectively, of the first substrate 110 and so as to have vias 186 that extend essentially vertically therethrough in order to electrically connect the first and second ground rings (as shown in FIGS. 9A-9B). Optionally, at process step 1106 the second substrate 120 can be formed so as to have first and second ground rings 189.1 and 189.2 on the first and second sides 129.1 and 129.2, respectively, and so as to have vias 188 that extend therethrough in order to electrically connect the first and second ground rings (as shown in FIGS. 10A-10B).

Figure 12D:
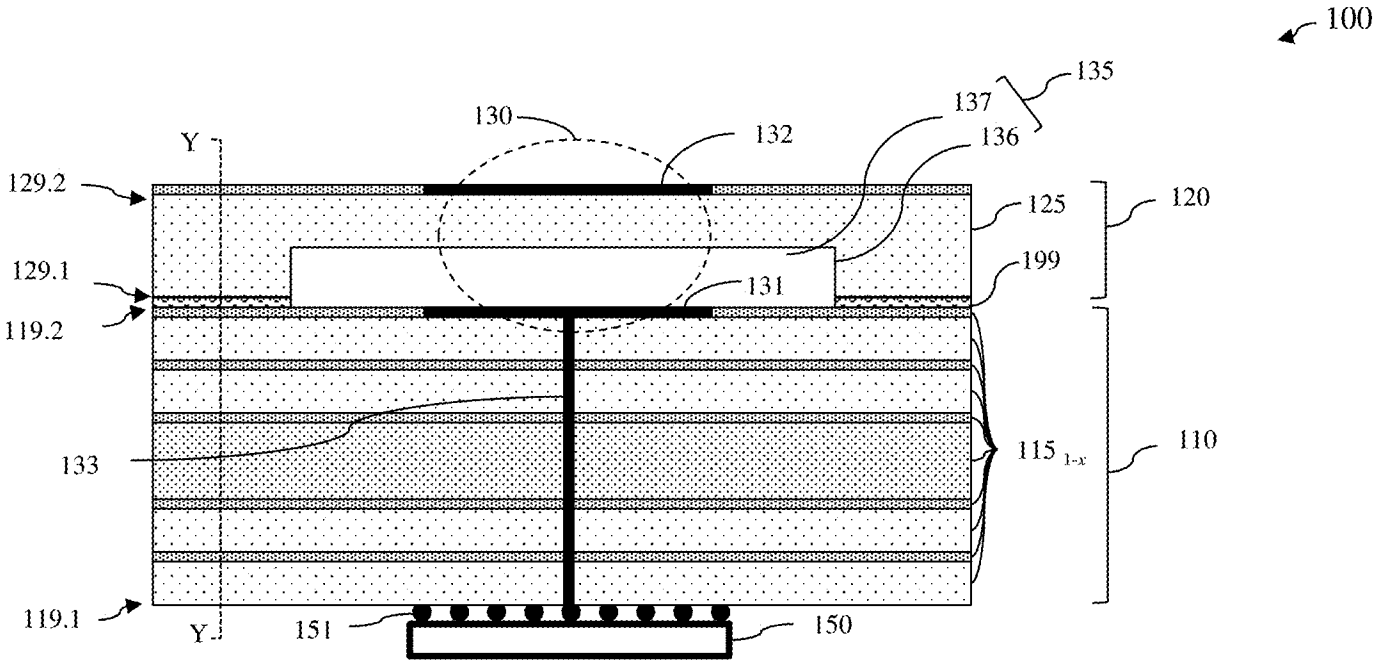

The method can further include mounting the chip 150 on the first side 119.1 of the first substrate 110 (e.g., using solder balls (as illustrated), copper pillars, wire bond interconnections, or any other suitable interconnect structure for mounting chips on carriers) so that it is electrically connected to the metal interconnect structure 133 and, thereby the first antenna element 131 (see process step 1108 and FIG. 12D).

Finally, the method can include adhering the second side 119.2 of the first substrate 110 to the first side 129.1 of the second substrate 120 using an adhesive 199 in order to complete the microelectronics package 100 (see process step 1110 and FIG. 12D). The adhesive 199 can be, for example, an epoxy adhesive. Such an epoxy adhesive can be either screen-printed or dispensed onto the first side of the second substrate and/or the second side of the first substrate. Then, the second substrate can be placed on the second substrate and the adhesive can be cured in order to adhere the second substrate to the first substrate. As mentioned above, the epoxy adhesive 199 may be applied so that a gap in the adhesive provides a vent for a trench that only contains air. Furthermore, as mentioned above, the first substrate and/or the second substrate may be formed at process steps 1104-1106 with a pair of ground rings on the first and second sides. If both substrates have such ground rings, then the adhesive used at process step 1110 could be a conductive epoxy adhesive, which both adheres the first substrate 110 to the second substrate 120 and also electrically connects the second ground ring 187.2 on the first substrate 110 to the first ground ring 189.1 on the second substrate 120. An exemplary conductive adhesive that could be used is an epoxy adhesive that includes metal particles such as silver particles.

Process steps similar to those described above for forming the microelectronics package 100 of FIGS. 1A-1C can be employed to form the microelectronics package 400 of FIGS. 4A-4F.

Figure 2A:
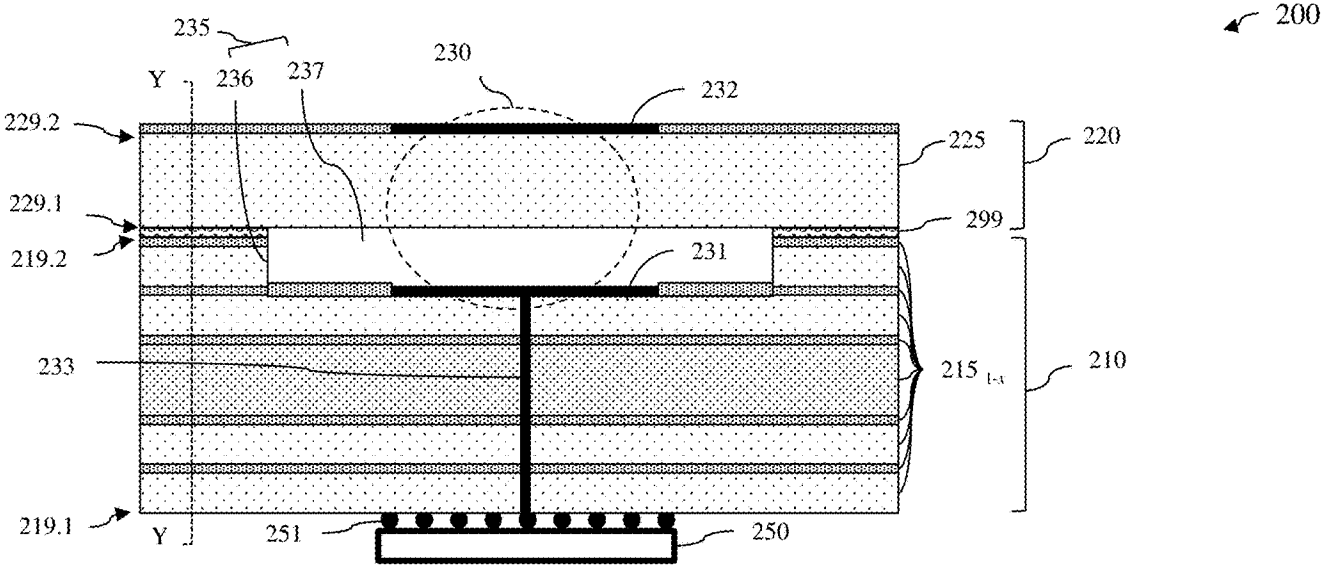
FIGS. 2A-2B are cross-section diagrams of another embodiment of the microelectronics package.
Figure 2B:
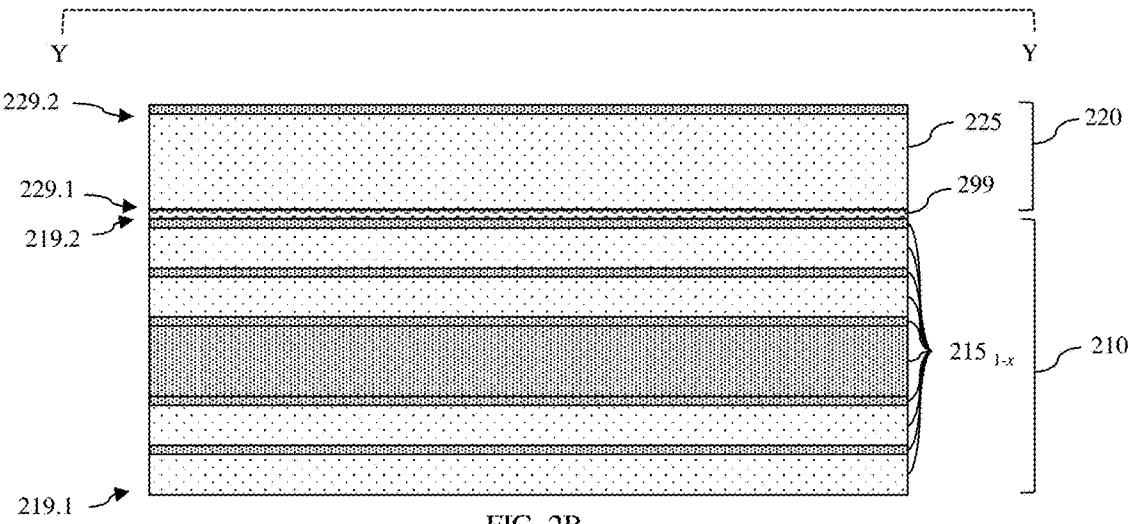

In another embodiment of the method, a design for a microelectronics package, such as the microelectronics package 200 of FIGS. 2A-2B could be developed (see process step 1101).

Figures 14A, 14B, 14C:
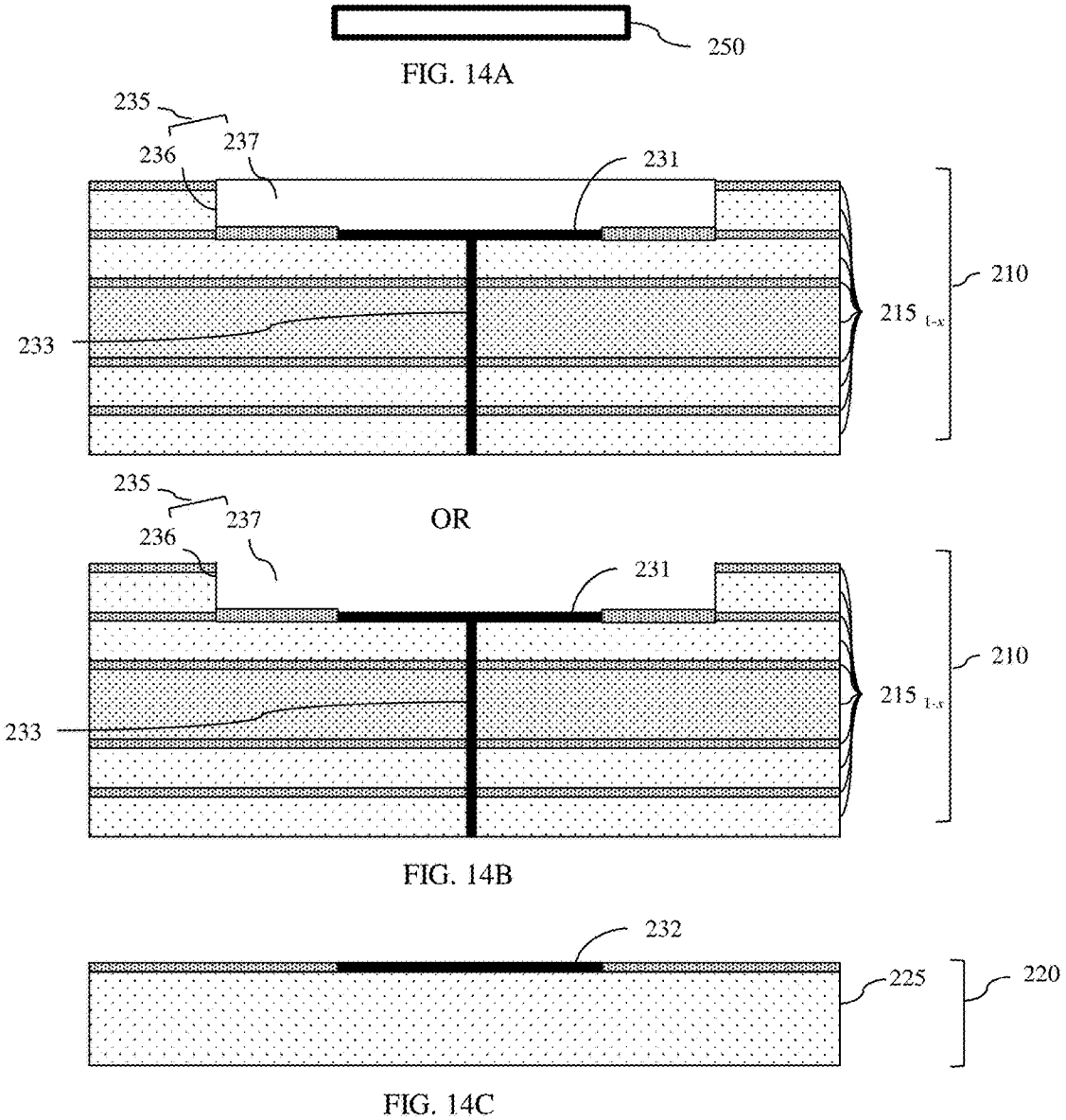
FIGS. 14A-14D are cross-section diagrams illustrating partially completed structures during formation of the microelectronics package shown in FIGS. 2A-2B according to the flow diagram of FIG. 11.

The method can include fabricating the chip 250 for the microelectronics package 200 according to the design (see process step 1102 and FIG. 14A).

The method can further include fabricating a first substrate 210 for the microelectronics package 200 according to the design (see process step 1104 and FIG. 14B). As illustrated, the first substrate 210 can be fabricated as a laminate substrate that includes multiple thin organic layers $\mathbf{215}_{1-x}$ (e.g., of polymers, resins, etc.), a first side 219.1 (e.g., a bottom side) and a second side 219.2 (e.g., a top side) opposite the bottom side. A trench 236 can be formed (e.g., lithographically patterned and etched, mechanically milled, laser cut, etc.) in the laminate substrate such that it extends from the second side 219.2 some distance toward the first side 219.1. A first antenna element 231 (e.g., a metal pad, such as a copper pad) for the multi-element antenna 230 can be formed (e.g., using a plating process) at the bottom of the trench 236. The trench 236 can remain unfilled such that it contains only air (which is an ultra-low-K dielectric material 237) above the first antenna element 231, thereby forming an ultra-low-K dielectric region 235 over the first antenna element 231. In this case, the process steps described above should also include formation a vent for the trench 236 (e.g., a lateral vent in the first substrate 210, a vertical vent in the first substrate 210 or, at process step 1110, a gap in the adhesive 299 between the first and second substrates 210 and 220). Alternatively, a solid ultra-low-K dielectric material 237 can be deposited into the trench 236, thereby forming the ultra-low-K dielectric region 235 over the first antenna element 231. Additionally, the first substrate 210 can be formed so as to include a metal interconnect structure 233 (e.g., a plated-through-via or a combination of vias and wires) embedded within the layers $\mathbf{215}_{1-x}$ and extending from the first antenna element 231 to the first side 219.1 (e.g., the bottom side) of the first substrate 210. The above-mentioned components of the first substrate 210 can be formed using conventional processing techniques.

The method can further include fabricating a second substrate 220 for the microelectronics package 200 according to the design (see process step 1106 and FIG. 14C). As illustrated, the second substrate 220 can be fabricated by providing a single polymer layer 225 with planar bottom and top surfaces; and forming a second antenna element 232 (e.g., a metal pad, such as a copper pad) for the multi-element antenna 230 on the top surface of that polymer layer 225 (i.e., on the second side 229.2 of the second substrate 220) using, for example, a plating process.

Alternatively, fabrication of the second substrate 220 could include forming an additional organic laminate substrate. The additional organic laminate substrate for the second substrate could be similar to the organic laminate substrate for the first substrate (e.g., could have essentially the same layers) or could be different from the organic laminate substrate for the first substrate. For example, the additional laminate substrate for the second substrate could be formed to have a core with glass fiber reinforcement, to be coreless, etc. Following formation of the additional organic laminate substrate, the second antenna element 232 could be formed on the top surface (e.g., using a plating process).

Optionally, process step 1104 of fabricating the first substrate 210 and/or process step 1106 of fabricating the second substrate 220 can include forming additional features in or on the substrate (e.g., see the discussion above regarding formation of ground rings and vias in the substrates).

Figure 14D:
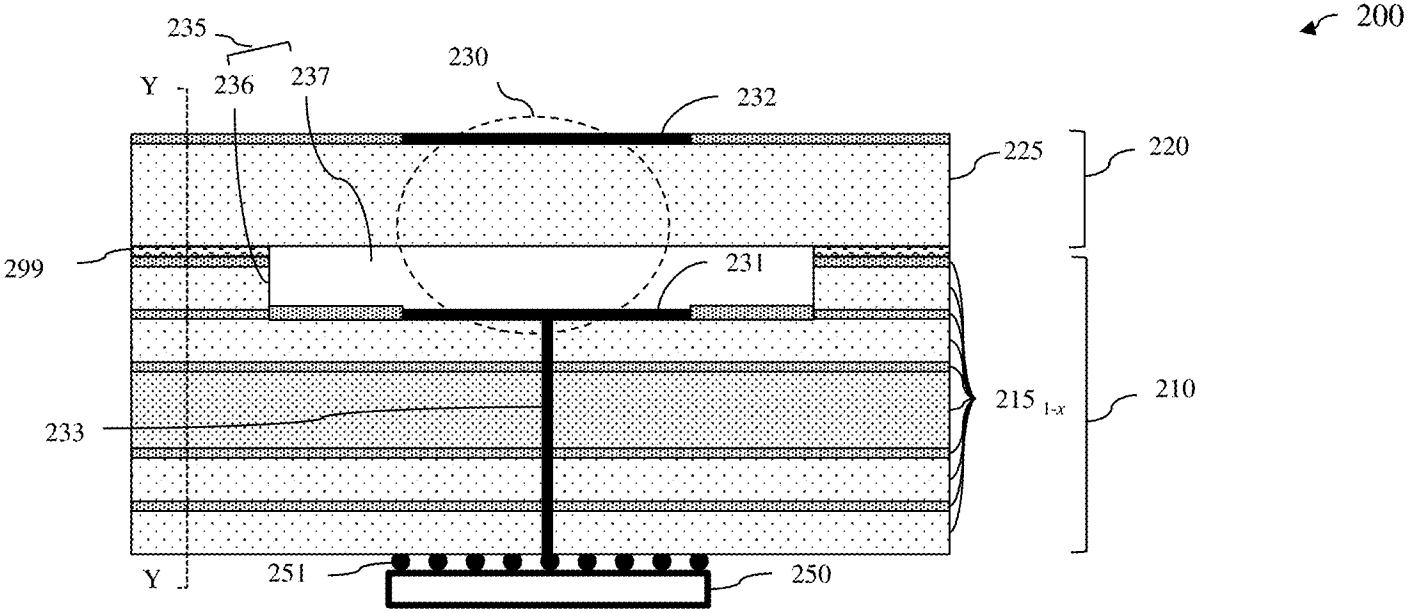

The method can further include mounting the chip 250 on the first side 219.1 of the first substrate 210 (e.g., using solder balls (as illustrated), copper pillars, wire bond interconnections, or any other suitable interconnect structure for mounting chips on carriers) so that it is electrically connected to the metal interconnect structure 233 and, thereby the first antenna element 231 (see process step 1108 and FIG. 14D).

Finally, the method can include adhering the second side 219.2 of the first substrate 210 to the first side 229.1 of the second substrate 220 using an adhesive 299 in order to complete the microelectronics package 200 (see process step 1110 and FIG. 14D). The adhesive 299 can be, for example, an epoxy adhesive. Such an epoxy adhesive can be either screen-printed or dispensed onto the first side of the second substrate and/or the second side of the first substrate. Then, the second substrate can be placed on the second substrate and the adhesive can be cured in order to adhere the second substrate to the first substrate. As mentioned above, the epoxy adhesive 299 may be applied so that a gap in the adhesive provides a vent for a trench that only contains air. Furthermore, as mentioned above, the first substrate and/or the second substrate may be formed at process steps 1104-1106 with a pair of ground rings on the first and second sides. If both substrates have such ground rings, then the adhesive used at process step 1110 could be a conductive epoxy adhesive, which both adheres the first substrate 210 to the second substrate 220 and also electrically connects adjacent ground rings on the two substrates. An exemplary conductive adhesive that could be used is an epoxy adhesive that includes metal particles such as silver particles.

Process step similar to those described above form forming the microelectronics package 200 of FIGS. 2A-2B can also be employed to form the microelectronics package 500 of FIGS. 5A-5E.

Figure 3A:
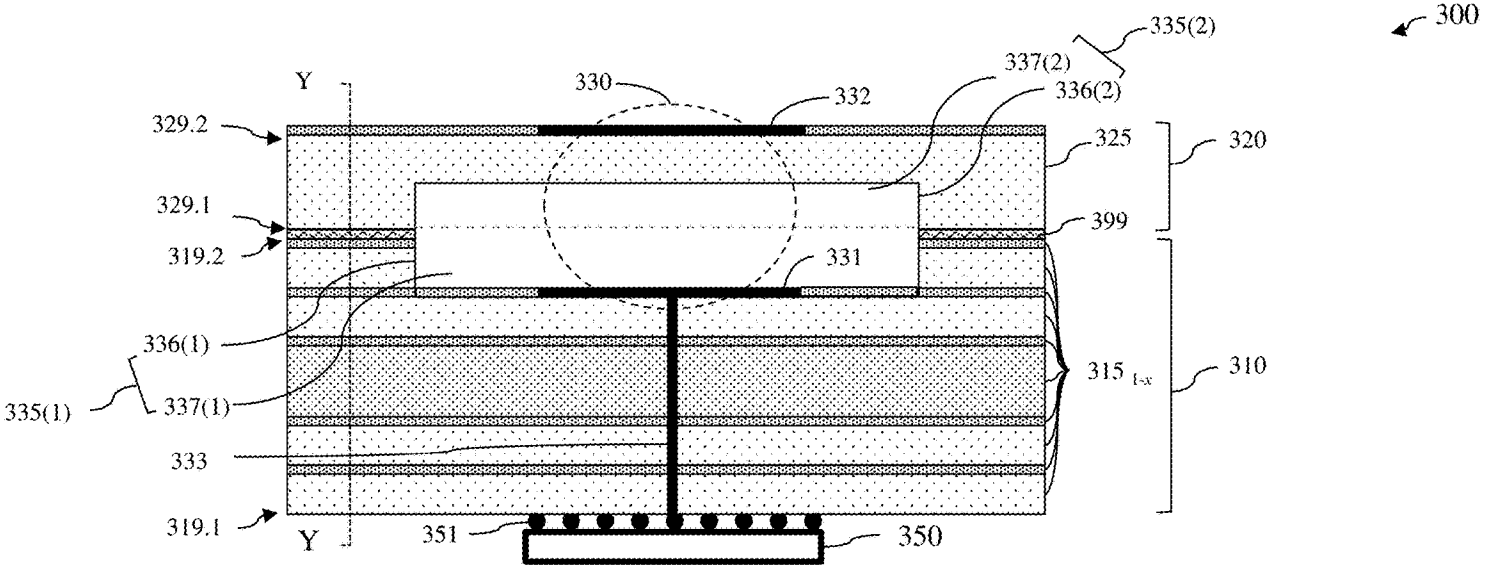
FIGS. 3A-3B are cross-section diagrams of yet another embodiment of the microelectronics package.
Figure 3B:
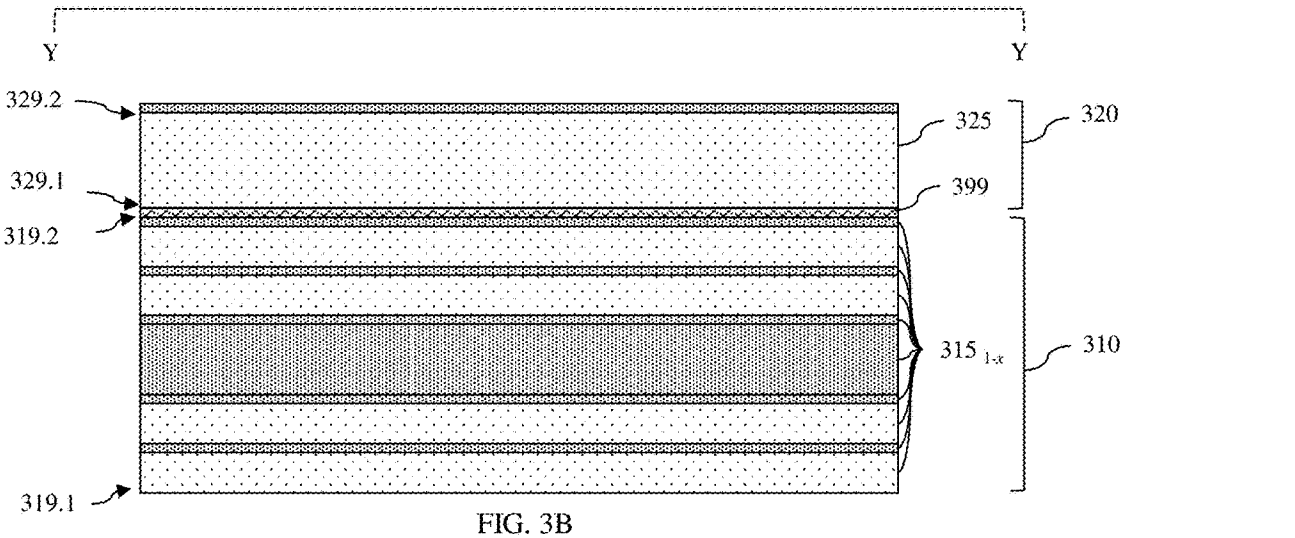
Figure 4A:
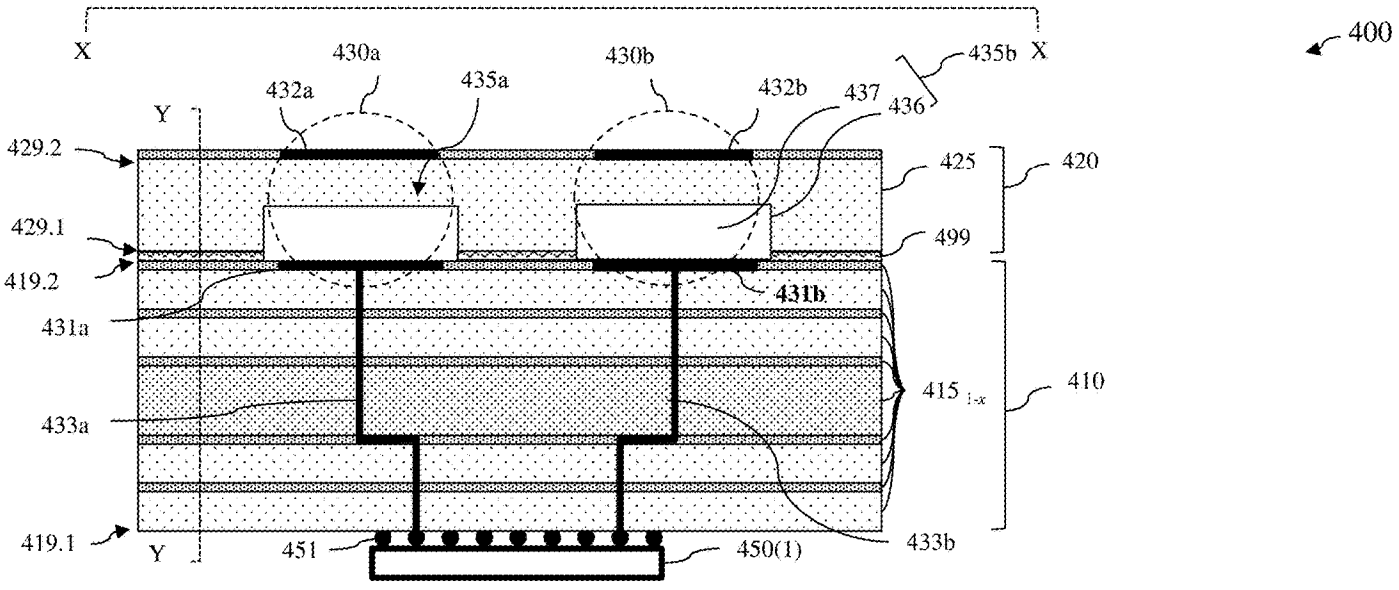
FIGS. 4A-4C are cross-section diagrams of yet another embodiment of a microelectronics package.
Figure 4B:
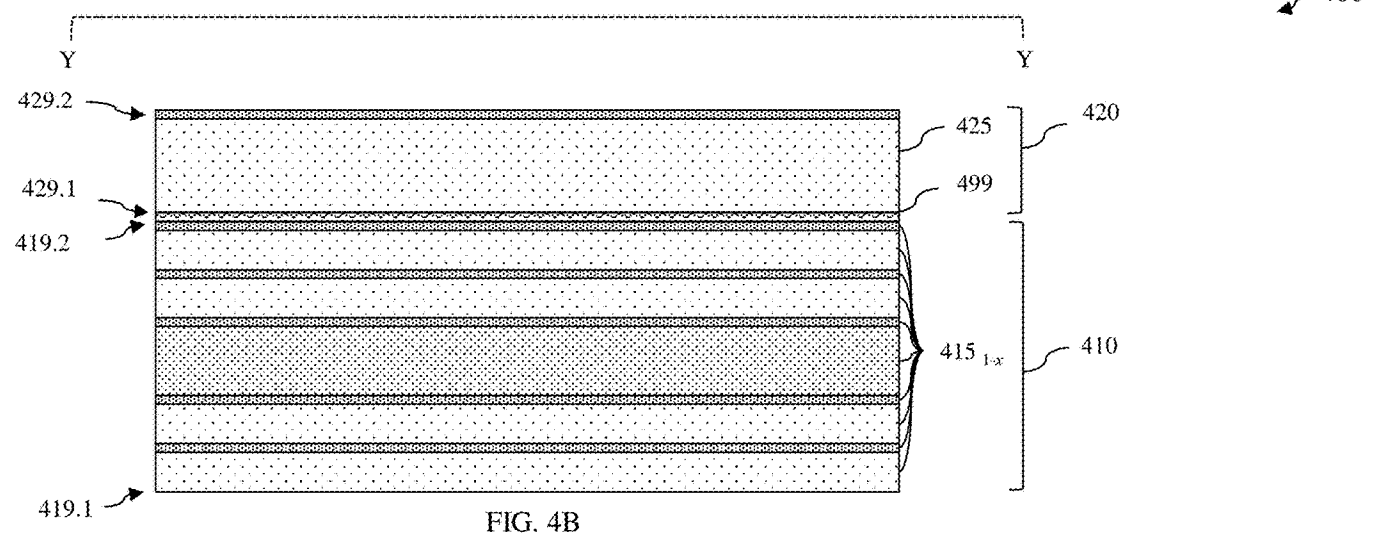
Figure 4C:
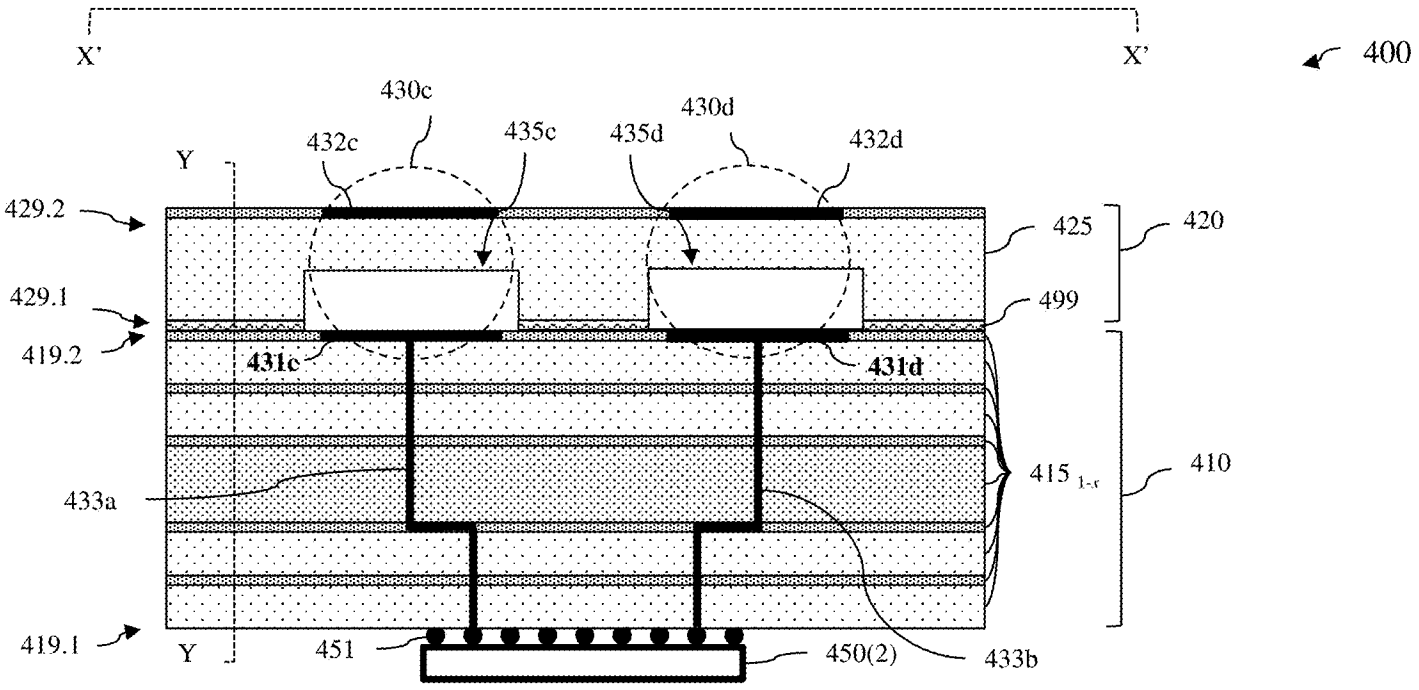
Figure 4E:
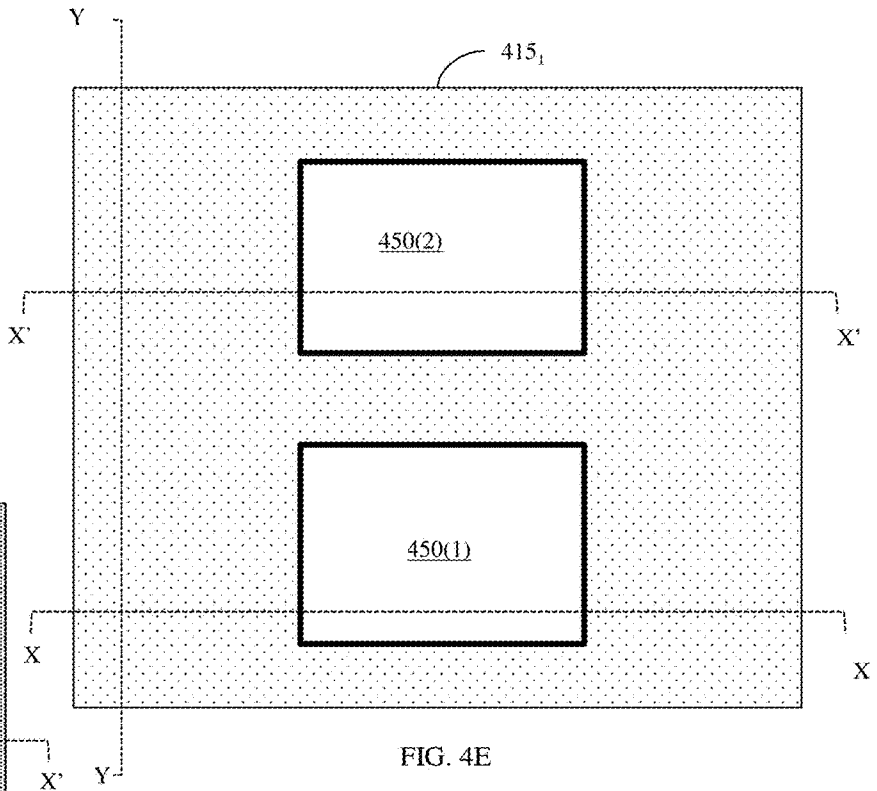
FIG. 4E is a drawing of chips on the opposite side of that microelectronics package.
Figure 4D:
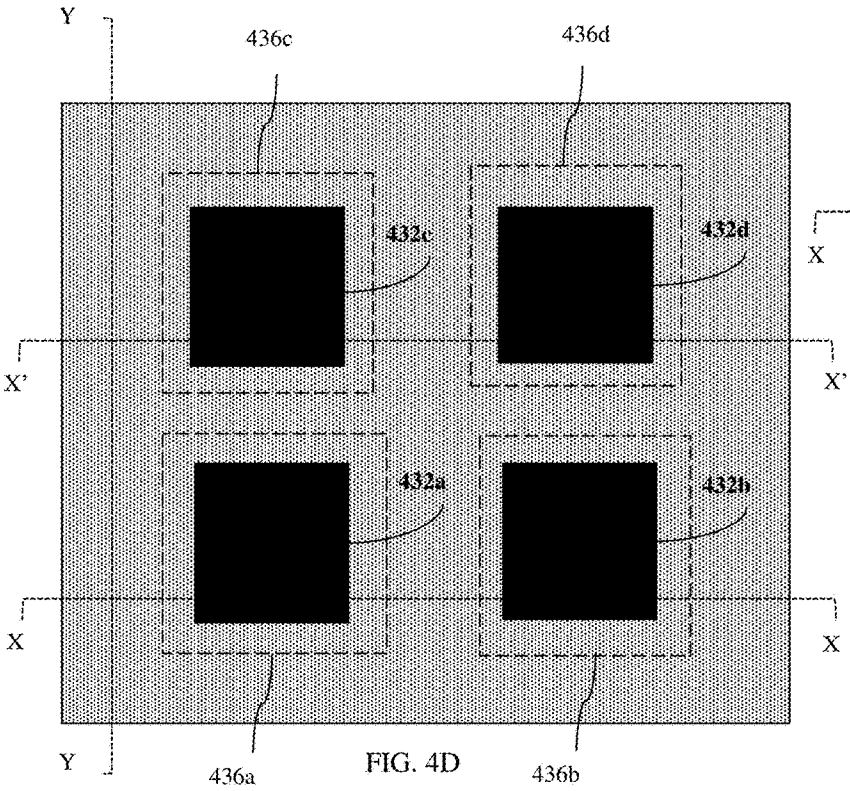
FIG. 4D is drawing of parasitic antenna elements on one side of that microelectronics package.
Figure 4F:
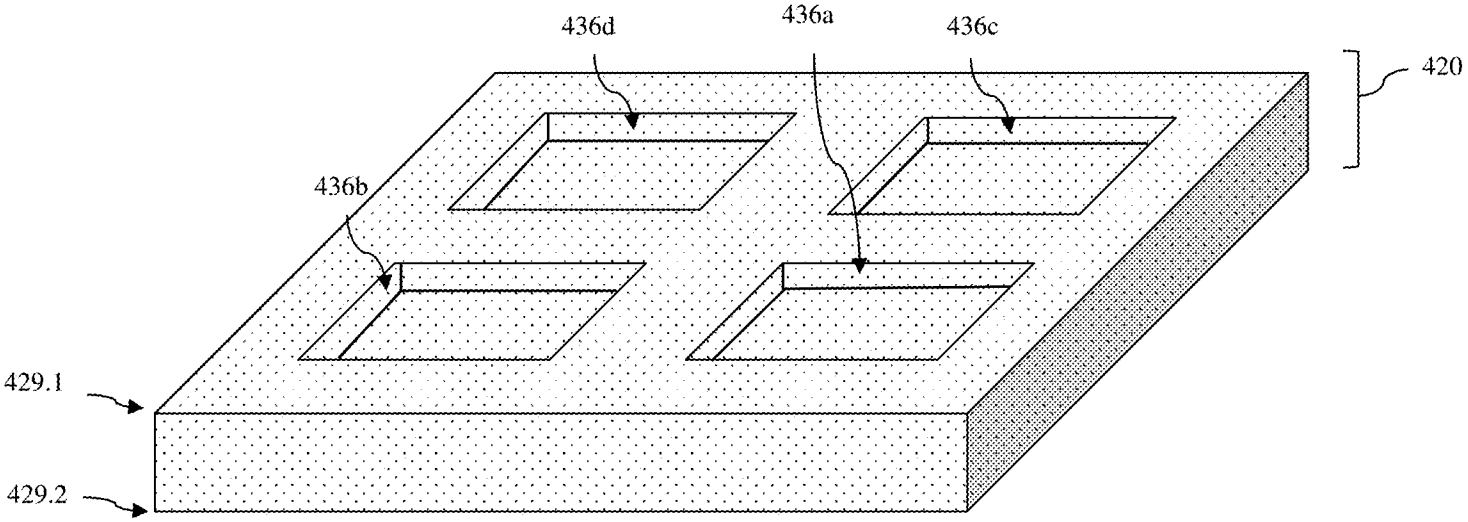
FIG. 4F is a perspective view drawing illustrating the second substrate of that microelectronics package.
Figure 5A:
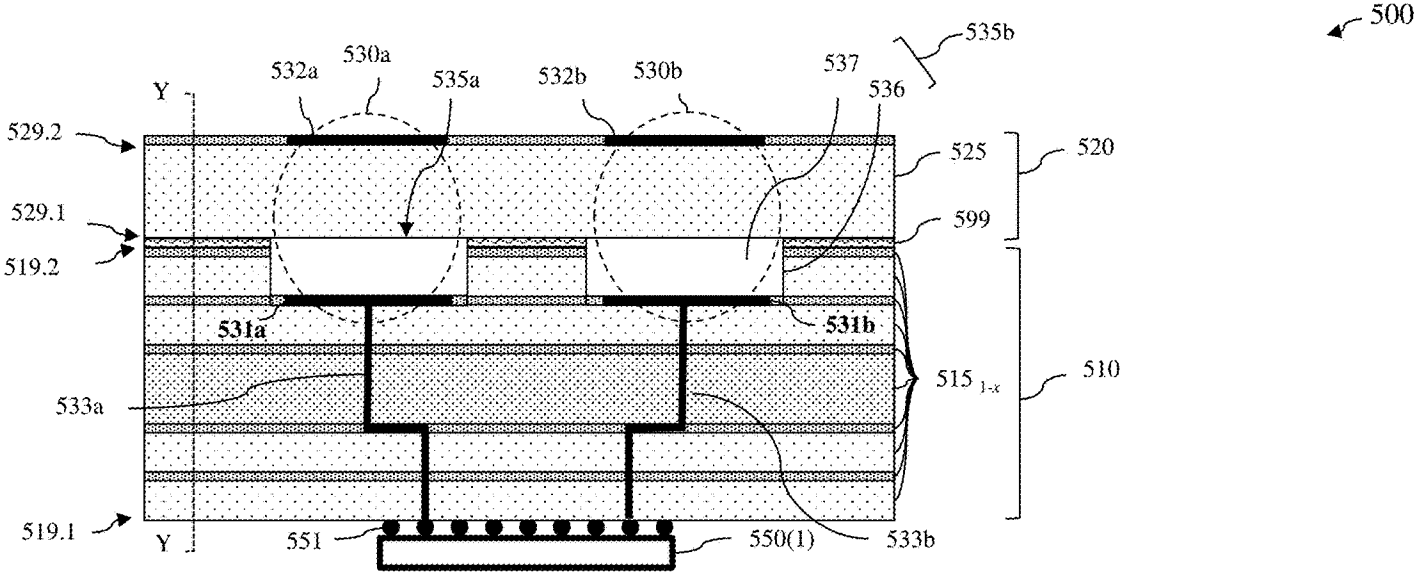
FIGS. 5A-5C are cross-section diagrams of yet another embodiment of the microelectronics package.
Figure 5B:
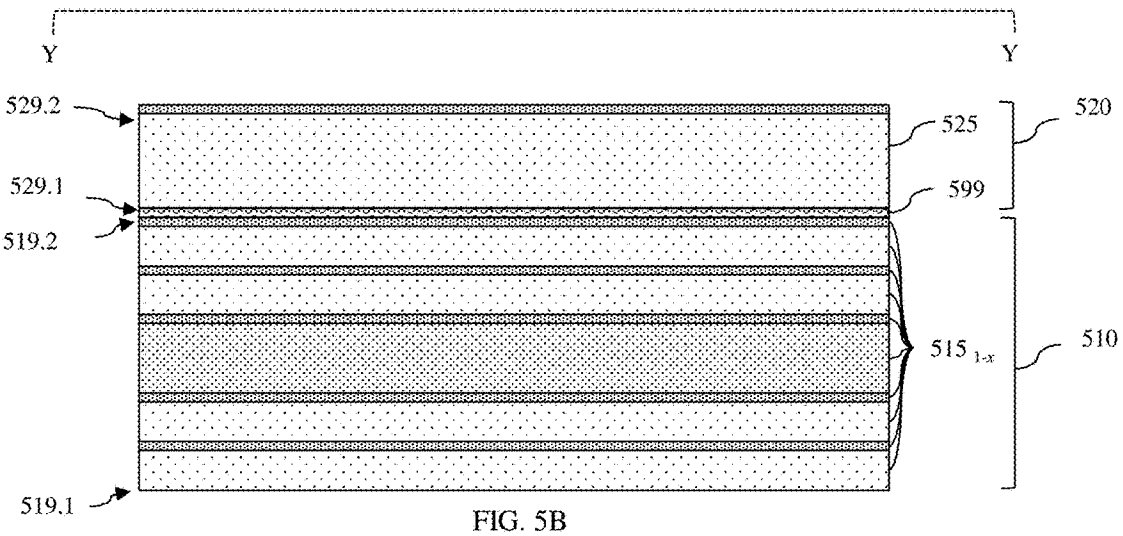
Figure 5C:
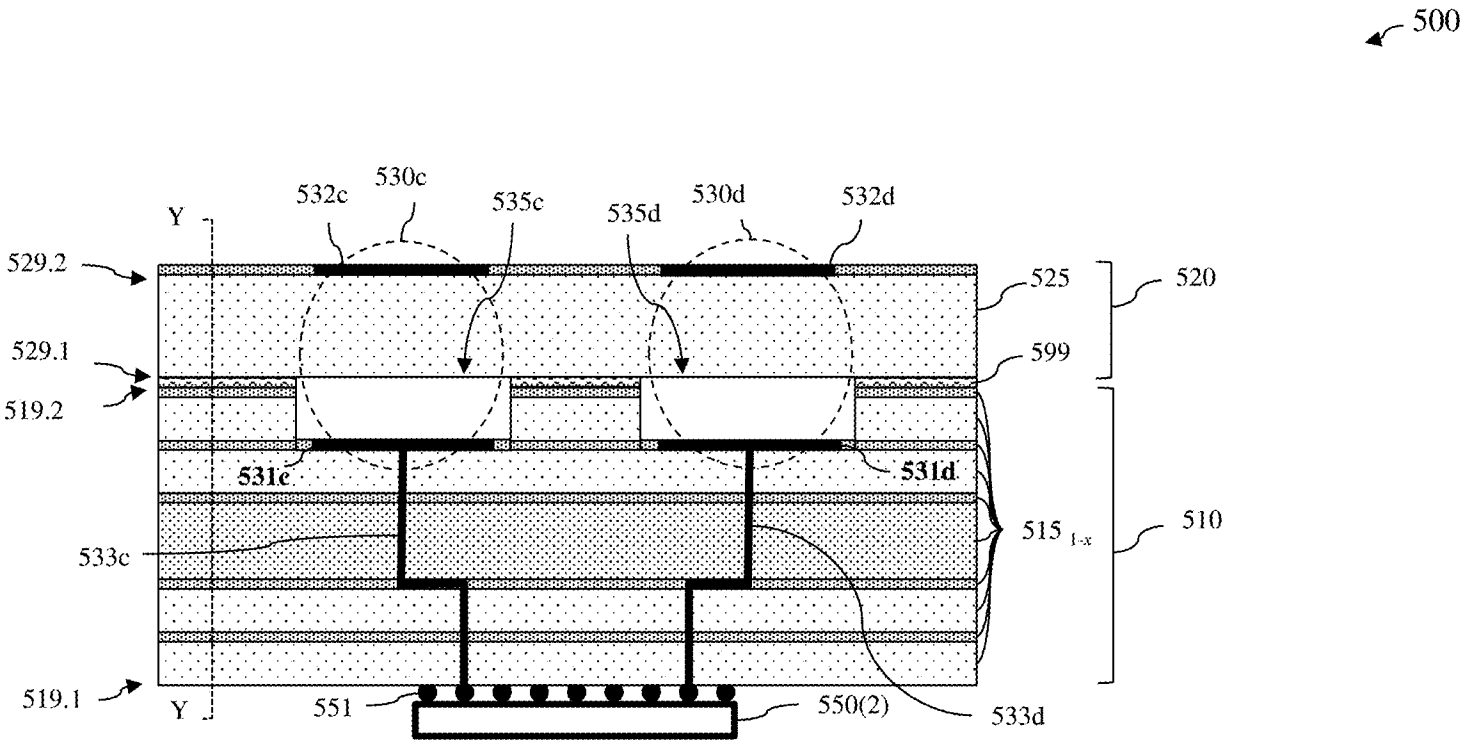
Figure 5E:
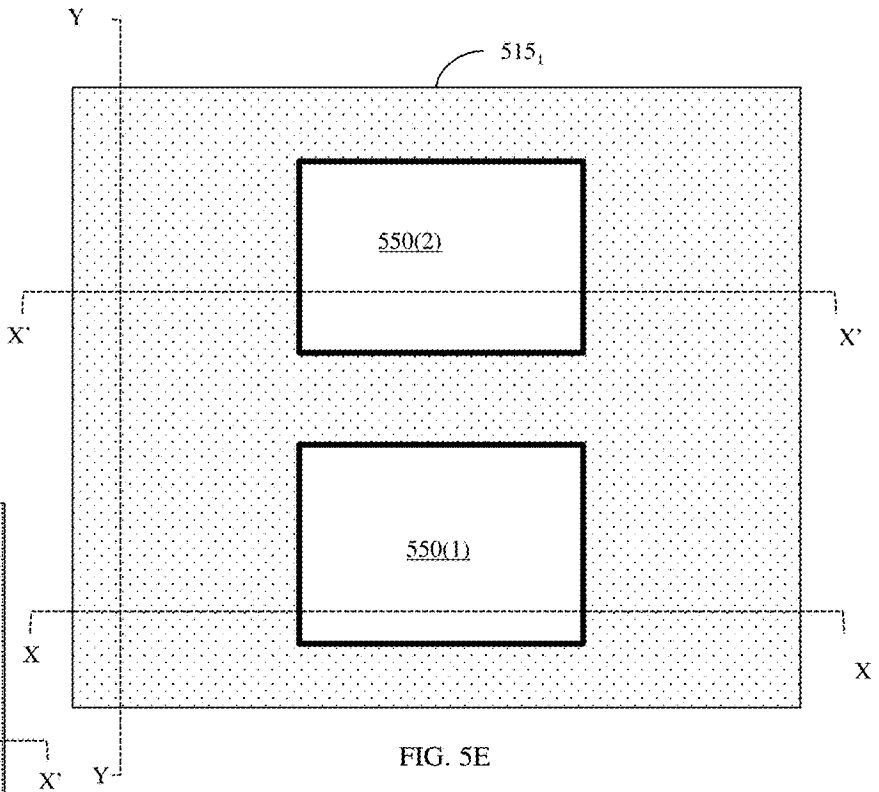
FIG. 5E is a drawing of chips on the opposite side of that microelectronics package.
Figure 5D:
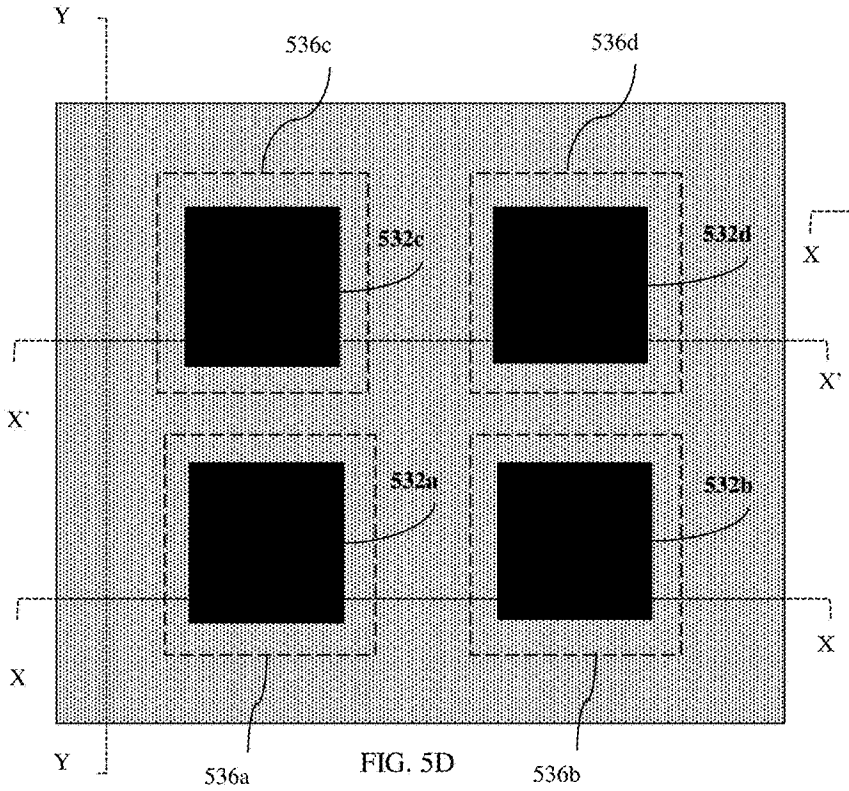
FIG. 5D is drawing of parasitic antenna elements on one side of that microelectronics package.
Figure 6A:
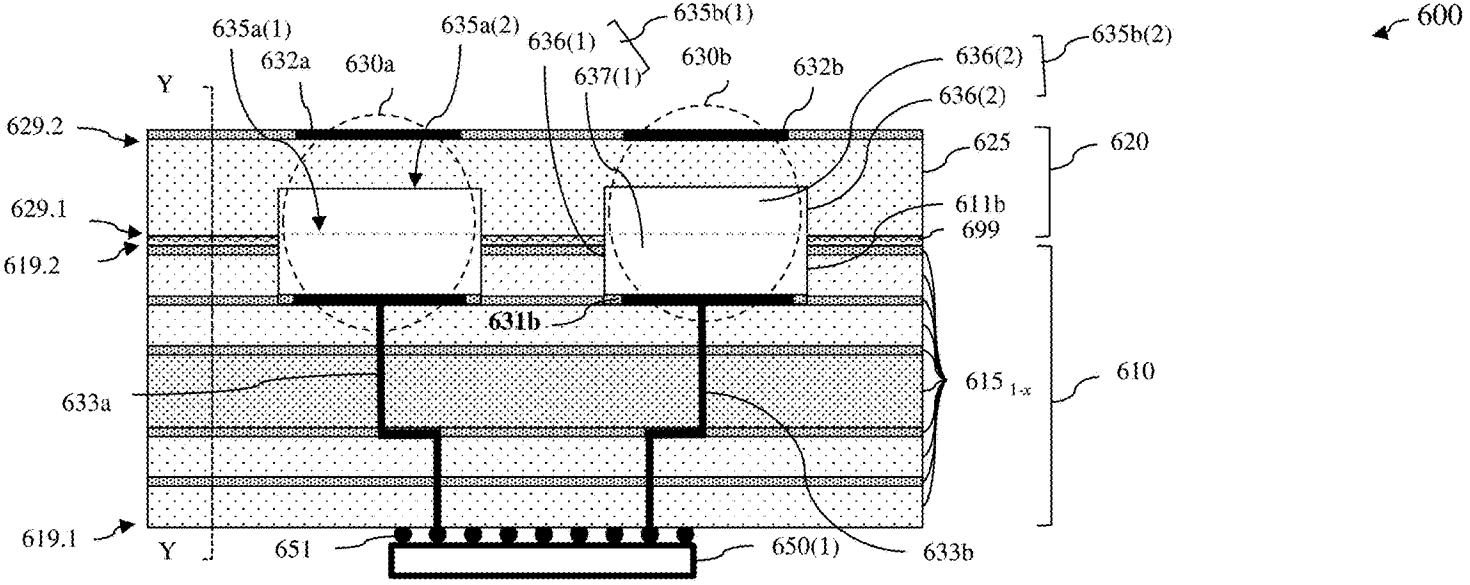
FIGS. 6A-6C are cross-section diagrams of yet another embodiment of the microelectronics package.
Figure 6B:
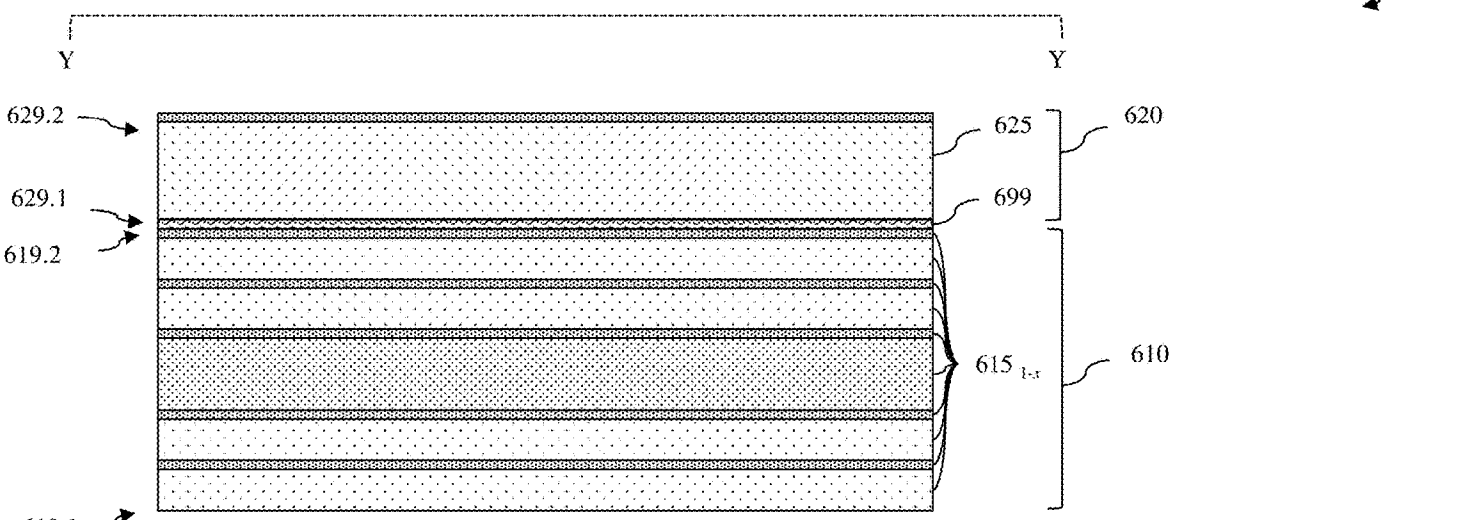
Figure 6C:
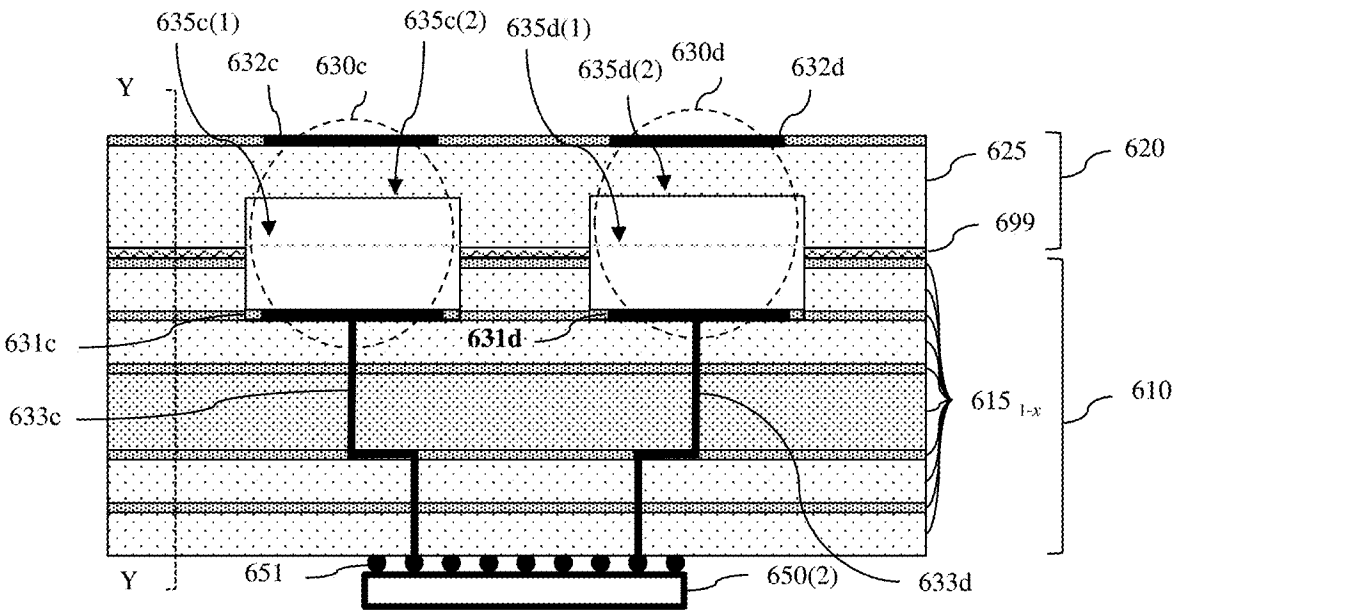
Figure 6E:
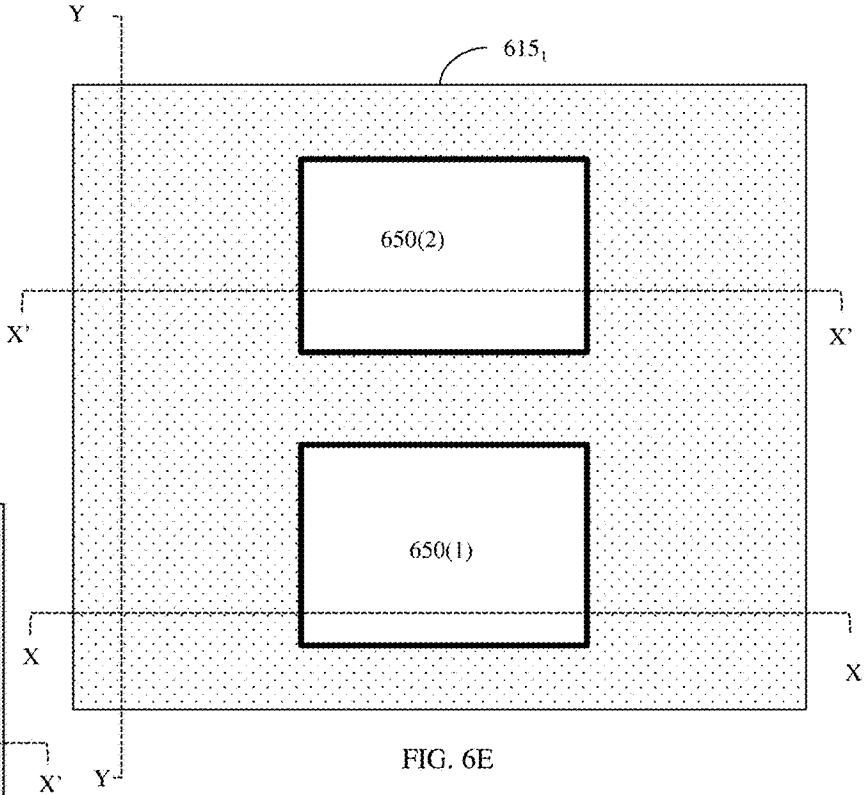
FIG. 6E is a drawing of chips on the opposite side of that microelectronics package.
Figure 6D:
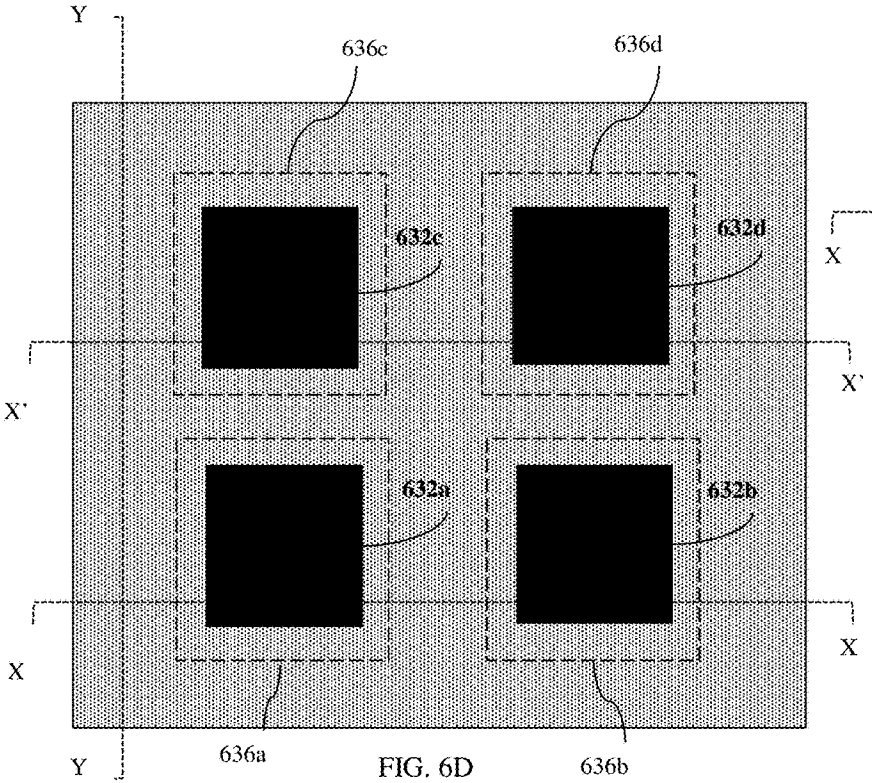
FIG. 6D is drawing of parasitic antenna elements on one side of that microelectronics package.

In yet another embodiment of the method, a design for a microelectronics package, such as the microelectronics package 300 of FIGS. 3A-3B could be developed (see process step 1101).

Figure 15A:
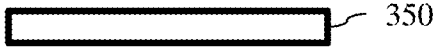
FIGS. 15A-15D are cross-section diagrams illustrating partially completed structures during formation of the microelectronics package shown in FIGS. 3A-3B according to the flow diagram of FIG. 11.

This method can include fabricating the chip 350 for the microelectronics package 300 according to the design (see process step 1102 and FIG. 15A).

Figure 15B:
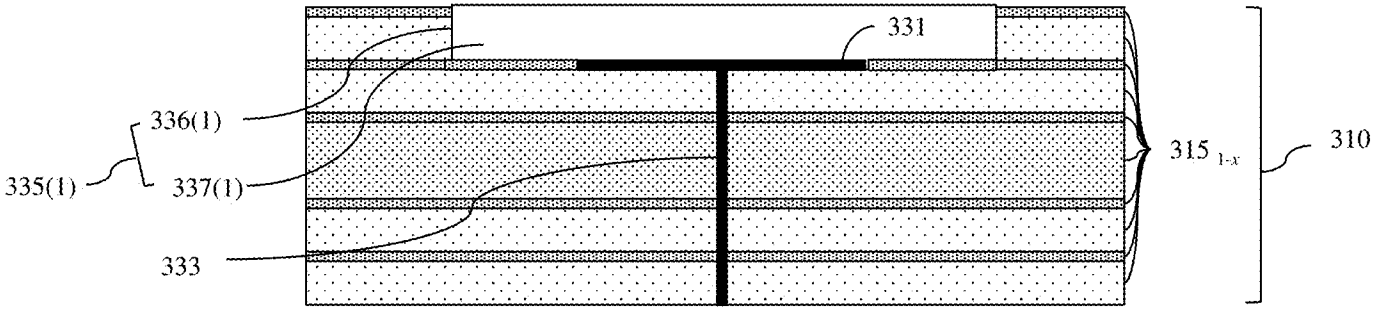
Figure 15B:
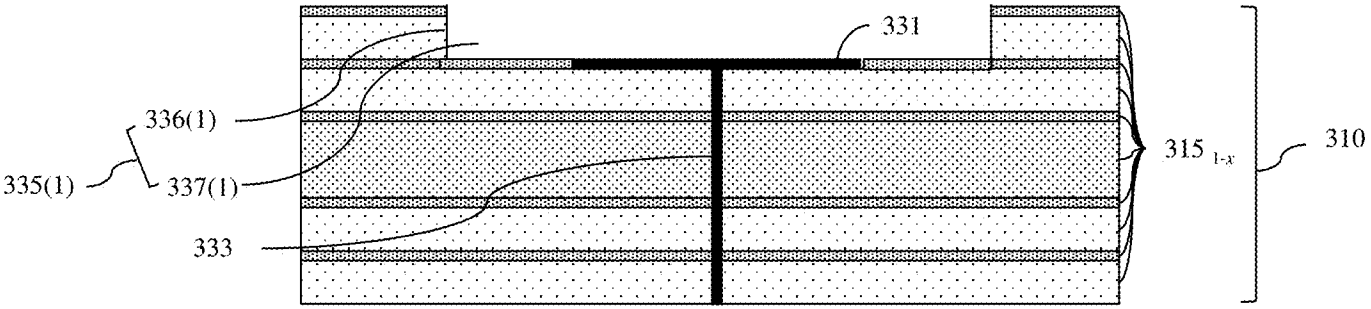

The method can further include fabricating a first substrate 310 for the microelectronics package 300 according to the design (see process step 1104 and FIG. 15B). As illustrated, the first substrate 310 can be fabricated as a laminate substrate that includes multiple thin organic layers $\mathbf{315}_{1-x}$ (e.g., of polymers, resins, etc.), a first side 319.1 (e.g., a bottom side) and a second side 319.2 (e.g., a top side) opposite the bottom side. A first trench 336.1 can be formed (e.g., lithographically patterned and etched, mechanically milled, laser cut, etc.) in the laminate substrate such that it extends from the second side 319.2 some distance toward the first side 319.1. A first antenna element 331 (e.g., a metal pad, such as a copper pad) for the multi-element antenna 330 can be formed (e.g., using a plating process) at the bottom of the first trench 336.1. The first trench 336.1 can remain unfilled such that it contains only air (which is a first ultra-low-K dielectric material 337.1) above the first antenna element 331, thereby forming a first ultra-low-K dielectric region 335.1 over the first antenna element 33. In this case, the process steps described above should also include formation a vent for the trench 336.1 (e.g., a lateral vent in the first substrate 310, a vertical vent in the first substrate 310 or, at process step 1110, a gap in the adhesive 399 between the first and second substrates 310 and 320). Alternatively, a solid first ultra-low-K dielectric material 337.1 can be deposited into the first trench 336.1, thereby forming a first ultra-low-K dielectric region 335.1 over the first antenna element 331. Additionally, the first substrate 310 can be formed so as to include a metal interconnect structure 333 (e.g., a plated-through-via or a combination of vias and wires) embedded within the layers $\mathbf{315}_{1-x}$ and extending from the first antenna element 331 to the first side 319.1 (e.g., the bottom side) of the first substrate 310. The above-mentioned components of the first substrate 310 can be formed using conventional processing techniques.

Figures 15C, 15D:
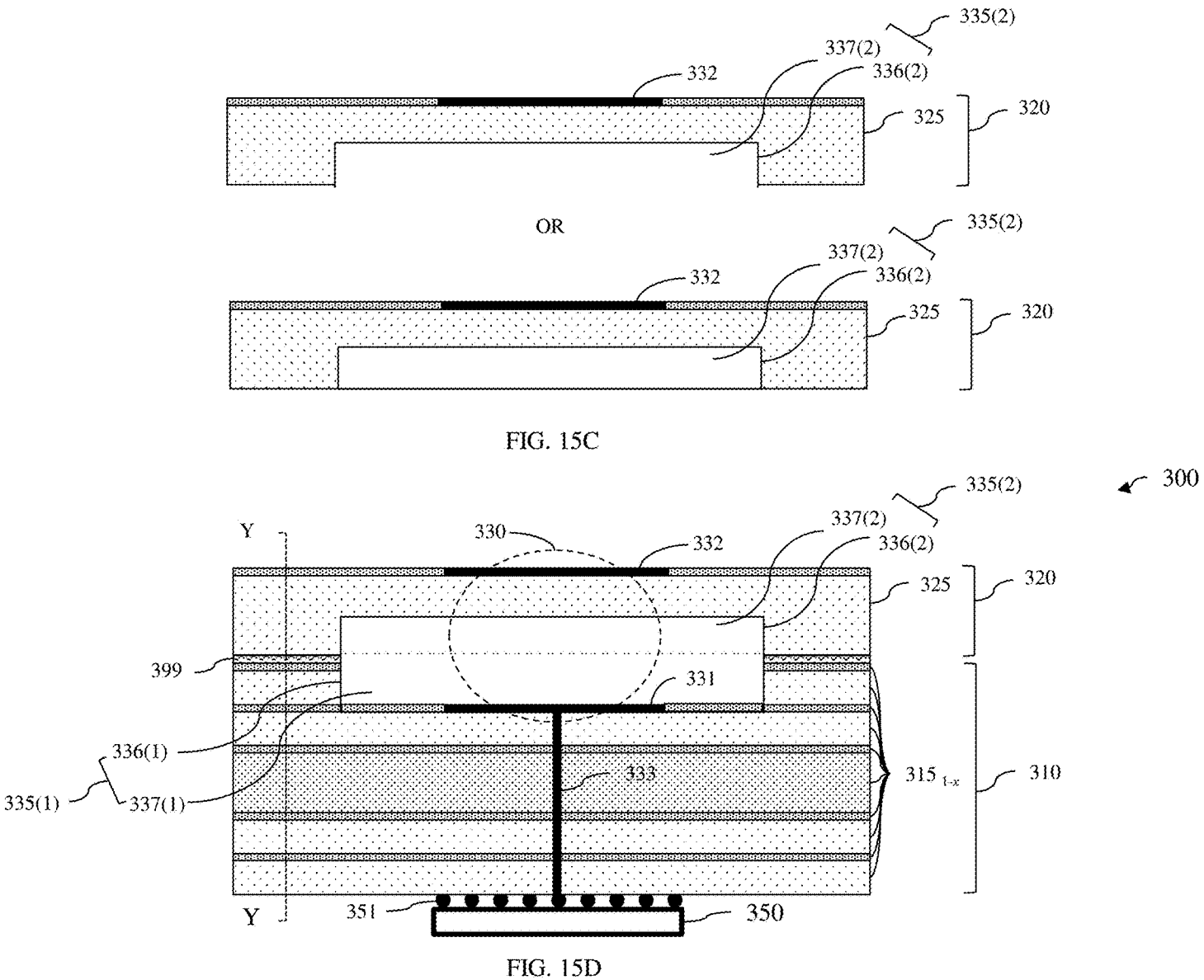

The method can further include fabricating a second substrate 320 for the microelectronics package 300 according to the design (see process step 1106 and FIG. 15C). As illustrated, the second substrate 320 can be fabricated so as to have a second ultra-low-K dielectric region 335.2 (which, in the resulting microelectronics package, will be aligned above and adjacent to the first ultra-low-K dielectric region 335.1). This second ultra-low-K dielectric region 335.2 can include a second trench 336.2, which extends into the first side 329.1 (e.g., the bottom side) of the second substrate 320. The second ultra-low-K dielectric region 335.2 can further include a second ultra-low-K dielectric material 337.2 within the second trench 336.2. This second substrate 320 can further be fabricated so as to have a second antenna element 332 on the second side 329.2 aligned above and physically separated from the second ultra-low-K dielectric region 335.2. The various process techniques described in detail above with respect to the fabrication of the second substrate 120 of the microelectronics package 100 could also be employed to form the second substrate 320 of the microelectronics package 300.

It should be noted that first ultra-low-K dielectric material 337.1 and the second ultra-low-K dielectric material 337.2 can be either the same dielectric material or different dielectric materials.

Optionally, process step 1104 of fabricating the first substrate 310 and/or process step 1106 of fabricating the second substrate 320 can include forming additional features in or on the substrate (e.g., see the discussion above regarding formation of ground rings and vias in the substrates).

The method can further include mounting the chip 350 on the first side 319.1 of the first substrate 310 (e.g., using solder balls (as illustrated), copper pillars, wire bond interconnections, or any other suitable interconnect structure for mounting chips on carriers) so that it is electrically connected to the metal interconnect structure 133 and, thereby the first antenna element 131 (see process step 1108 and FIG. 15D).

Finally, the method can include adhering the second side 319.2 of the first substrate 310 to the first side 329.1 of the second substrate 320 using an adhesive 399 in order to complete the microelectronics package 300 (see process step 1110 and FIG. 15D). The adhesive 399 can be, for example, an epoxy adhesive. Such an epoxy adhesive can be either screen-printed or dispensed onto the first side of the second substrate and/or the second side of the first substrate. Then, the second substrate can be placed on the second substrate and the adhesive can be cured in order to adhere the second substrate to the first substrate. As mentioned above, the epoxy adhesive 299 may be applied so that a gap in the adhesive provides a vent for a trench that only contains air. Furthermore, as mentioned above, the first substrate and/or the second substrate may be formed at process steps 1104-1106 with a pair of ground rings on the first and second sides. If both substrates have such ground rings, then the adhesive used at process step 1110 could be a conductive epoxy adhesive, which both adheres the first substrate 210 to the second substrate 220 and also electrically connects adjacent ground rings on the two substrates. An exemplary conductive adhesive that could be used is an epoxy adhesive that includes metal particles such as silver particles.

Process steps similar to those described above for forming the microelectronics package 300 of FIGS. 3A-3B can also be employed to form the microelectronics package 600 of FIGS. 6A-6E.

It should be understood that in the structures and methods described above, a semiconductor material refers to a material whose conducting properties can be altered by doping with an impurity. Exemplary semiconductor materials include, for example, silicon-based semiconductor materials (e.g., silicon, silicon germanium, silicon germanium carbide, silicon carbide, etc.) and gallium nitride-based semiconductor materials. A pure semiconductor material and, more particularly, a semiconductor material that is not doped with an impurity for the purposes of increasing conductivity (i.e., an undoped semiconductor material) is referred to in the art as an intrinsic semiconductor. A semiconductor material that is doped with an impurity for the purposes of increasing conductivity (i.e., a doped semiconductor material) is referred to in the art as an extrinsic semiconductor and will be more conductive than an intrinsic semiconductor made of the same base material. That is, extrinsic silicon will be more conductive than intrinsic silicon; extrinsic silicon germanium will be more conductive than intrinsic silicon germanium; and so on. Furthermore, it should be understood that different impurities (i.e., different dopants) can be used to achieve different conductivity types (e.g., P-type conductivity and N-type conductivity) and that the dopants may vary depending upon the different semiconductor materials used. For example, a silicon-based semiconductor material (e.g., silicon, silicon germanium, etc.) is typically doped with a Group III dopant, such as boron (B) or indium (In), to achieve P-type conductivity, whereas a silicon-based semiconductor material is typically doped a Group V dopant, such as arsenic (As), phosphorous (P) or antimony (Sb), to achieve N-type conductivity. A gallium nitride (GaN)-based semiconductor material is typically doped with magnesium (Mg) to achieve P-type conductivity or silicon (Si) to achieve N-type conductivity. Those skilled in the art will also recognize that different conductivity levels will depend upon the relative concentration levels of the dopant(s) in a given semiconductor region.

It should also be understood that the terminology used herein is for the purpose of describing the disclosed structures and methods and is not intended to be limiting. For example, as used herein, the singular forms "a", "an" and "the" are intended to include the plural forms as well, unless the context clearly indicates otherwise. Additionally, as used herein, the terms "comprises" "comprising", "includes" and/or "including" specify the presence of stated features, integers, steps, operations, elements, and/or components, but do not preclude the presence or addition of one or more other features, integers, steps, operations, elements, components, and/or groups thereof. Furthermore, as used herein, terms such as "right", "left", "vertical", "horizontal", "top", "bottom", "upper", "lower", "under", "below", "underlying", "over", "overlying", "parallel", "perpendicular", etc., are intended to describe relative locations as they are oriented and illustrated in the drawings (unless otherwise indicated) and terms such as "touching", "in direct contact", "abutting", "directly adjacent to", "immediately adjacent to", etc., are intended to indicate that at least one element physically contacts another element (without other elements separating the described elements). The term "laterally" is used herein to describe the relative locations of elements and, more particularly, to indicate that an element is positioned to the side of another element as opposed to above or below the other element, as those elements are oriented and illustrated in the drawings. For example, an element that is positioned laterally adjacent to another element will be beside the other element, an element that is positioned laterally immediately adjacent to another element will be directly beside the other element, and an element that laterally surrounds another element will be adjacent to and border the outer sidewalls of the other element. The corresponding structures, materials, acts, and equivalents of all means or step plus function elements in the claims below are intended to include any structure, material, or act for performing the function in combination with other claimed elements as specifically claimed.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A microelectronics package comprising:

a first substrate;

a second substrate, wherein the first substrate and the second substrate each have a first side and a second side opposite the first side and wherein the second side of the first substrate is adhered to the first side of the second substrate by an adhesive;

a chip mounted on the first side of the first substrate; and a multi-element antenna comprising: a first antenna element on the second side of the first substrate and electrically connected to the chip; and a second antenna element on the second side of the second substrate, wherein the second antenna element overlays and is physically separated from the first antenna element by at least one ultra-low-K dielectric region within at least one of the first side of the second substrate and the second side of the first substrate.

2. The microelectronics package of claim 1, wherein each ultra-low-K dielectric region comprises a trench and, in the trench, a dielectric material with a dielectric constant that is no greater than 2.5.

3. The microelectronics package of claim 2, wherein the dielectric material is air and wherein the trench is vented.

4. The microelectronics package of claim 2, wherein the dielectric material is any of air, a fluoropolymer and a porous fluoropolymer.

5. The microelectronics package of claim 1, wherein the second substrate comprises an ultra-low-K dielectric region comprising a trench that contains an ultra-low-K dielectric material, and wherein the trench extends from the first side of the second substrate adjacent to the first antenna element toward the second side of the second substrate adjacent to the second antenna element such that the ultra-low-K dielectric region and a thin portion of the second substrate are aligned with and between the first antenna element and the second antenna element.

6. The microelectronics package of claim 1, wherein the first substrate comprises an ultra-low-K dielectric region comprising a trench containing an ultra-low-K dielectric material, and wherein the trench extends from the second side of the first substrate toward the first side of the first substrate and the first antenna element is at a bottom of the trench such that the ultra-low-K dielectric region and the second substrate are between the first antenna element and the second antenna element.

7. The microelectronics package of claim 1, wherein the second antenna element is physically separated from the first antenna element by a first ultra-low-K dielectric region and a second ultra-low-K dielectric region, wherein the first substrate comprises the first ultra-low-K dielectric region comprising a first trench containing a first ultra-low-K dielectric material, wherein the first trench extends from the second side of the first substrate toward the first side of the first substrate and the first antenna element is at a bottom of the first trench, wherein the second substrate comprises the second ultra-low-K dielectric region adjacent to the first ultra-low-K dielectric region and comprising a second trench containing a second ultra-low-K dielectric material, and wherein the second trench extends from the first side of the second substrate toward the second antenna element at the second side of the second substrate such that the first ultra-low-K dielectric region, the second ultra-low-K dielectric region and a thin portion of the second substrate are aligned with and between the first antenna element and the second antenna element.

8. The microelectronics package of claim 7, wherein the first ultra-low-K dielectric material and the second ultra-low-K dielectric material are different dielectric materials.

9. The microelectronics package of claim 1, wherein the adhesive comprises any of:

a screen-printed epoxy adhesive; and a flow-on epoxy adhesive.

10. The microelectronics package of claim 1, wherein the first substrate and the second substrate each comprise a first ground ring on the first side and a second ground ring on the second side and connected to the first ground ring by vias, and wherein the adhesive comprises a conductive adhesive that electrically connects the second ground ring on the second side of the first substrate to the first ground ring on the first side of the second substrate.

11. A microelectronics package comprising:

a first substrate;

a second substrate, wherein the first substrate and the second substrate each have a first side and a second side opposite the first side and wherein the second side of the first substrate is adhered to the first side of the second substrate by an adhesive;

a chip mounted on the first side of the first substrate; and multiple multi-element antennas connected to the chip, wherein each antenna comprises a first antenna element on the second side of the first substrate and electrically connected to the chip; and a second antenna element on the second side of the second substrate, wherein, in each antenna, the second antenna element overlays and is physically separated from the first antenna element by at least one ultra-low-K dielectric region within at least one of the first side of the second substrate and the second side of the first substrate.

12. The microelectronics package of claim 11, wherein each ultra-low-K dielectric region comprises a trench and, in the trench, an ultra-low-K dielectric material with a dielectric constant that is no greater than 2.5.

13. The microelectronics package of claim 12, wherein the ultra-low-K dielectric material is air and wherein the trench is vented.

14. The microelectronics package of claim 12, wherein the ultra-low-K dielectric material is any of air, a fluoropolymer and a porous fluoropolymer.

15. The microelectronics package of claim 11, wherein the second substrate comprises multiple ultra-low-K dielectric regions comprising trenches and, in the trenches, an ultra-low-K dielectric material, and wherein the trenches extend from the first side of the second substrate adjacent to first antenna elements of the multi-element antennas toward second antenna elements of the multi-element antennas at the second side of the second substrate such that an ultra-low-K dielectric region and a thin portion of the second substrate are aligned with and between first and second antenna elements of each antenna.

16. The microelectronics package of claim 11, wherein the first substrate comprises multiple ultra-low-K dielectric regions comprising trenches and, in the trenches, an ultra-low-K dielectric material, wherein the trenches extend from the second side of the first substrate toward the first side of the first substrate and first antenna elements of the multi-element antennas are at bottoms of the trenches such that an ultra-low-K dielectric region and the second substrate are between first and second antenna elements of each antenna.

17. The microelectronics package of claim 11, wherein, in each antenna, the second antenna element is physically separated from the first antenna element by a first ultra-low-K dielectric region and a second ultra-low-K dielectric region, wherein the first substrate comprises multiple first ultra-low-K dielectric regions comprising first trenches and, in the first trenches, a first ultra-low-K dielectric material, wherein the first trenches extend from the second side of the first substrate toward the first side of the first substrate and first antenna elements of the multi-element antennas are at bottoms of the first trenches, wherein the second substrate comprises multiple second ultra-low-K dielectric regions adjacent to the first ultra-low-K dielectric regions, respectively, and comprising second trenches and, in the second trenches, a second ultra-low-K dielectric material, and wherein the second trenches extend from the first side of the second substrate toward second antenna elements of the multi-element antennas at the second side of the second substrate such that a first ultra-low-K dielectric region, a second ultra-low-K dielectric region and a thin portion of the second substrate are aligned with and between first and second elements of each antenna.

18. The microelectronics package of claim 17, wherein the first ultra-low-K dielectric material and the second ultra-low-K dielectric material are different dielectric materials.

19. The microelectronics package of claim 11, wherein the adhesive comprises any of:

a screen-printed epoxy adhesive; and a flow-on epoxy adhesive.

20. A method comprising:

fabricating multiple substrates for a microelectronics package, the substrates comprising a first substrate and a second substrate for a microelectronics package and each of the substrates having a first side and a second side opposite the first side;

mounting a chip on the first side of the first substrate; and adhering the first side of the second substrate to the second side of the first substrate to form the microelectronics package, wherein the fabricating, the mounting and the adhering are performed such that the microelectronics package comprises: a multi-element antenna comprising: a first antenna element on the second side of the first substrate and electrically connected to the chip; and a second antenna element on the second side of the second substrate, wherein the second antenna element overlays and is physically separated from the first antenna element by at least one ultra-low-K dielectric region within in at least one of the first side of the second substrate and the second side of the first substrate.

* * * * *